US007155919B2

(12) United States Patent
Gaudet et al.

(10) Patent No.: US 7,155,919 B2
(45) Date of Patent: Jan. 2, 2007

(54) CRYOPUMP TEMPERATURE CONTROL OF ARRAYS

(75) Inventors: Peter W. Gaudet, West Roxbury, MA (US); Donald A. Olsen, deceased, late of Millis, MA (US); by Carol Olsen, legal representative, Millis, MA (US); Michael J. Eacobacci, S. Attleboro, MA (US); John T. Harvell, deceased, late of Sudbury, MA (US); by Olive Harvell, legal representative, Sudbury, MA (US)

(73) Assignee: Brooks Automation, Inc., Chelmsford, MA (US)

( * ) Notice: Subject to any disclaimer, the term of this patent is extended or adjusted under 35 U.S.C. 154(b) by 388 days.

(21) Appl. No.: 10/750,547

(22) Filed: Dec. 31, 2003

(65) Prior Publication Data

US 2005/0081536 A1 Apr. 21, 2005

Related U.S. Application Data

(60) Continuation of application No. 10/225,485, filed on Aug. 20, 2002, now Pat. No. 6,755,028, which is a continuation of application No. 09/977,559, filed on Oct. 15, 2001, now Pat. No. 6,460,351, which is a continuation of application No. 09/826,692, filed on Apr. 5, 2001, now Pat. No. 6,318,093, which is a continuation of application No. 09/454,358, filed on Dec. 3, 1999, now Pat. No. 6,461,113, which is a continuation of application No. 08/517,091, filed on Aug. 21, 1995, now Pat. No. 6,022,195, which is a continuation-in-part of application No. 08/092,692, filed on Jul. 16, 1993, now Pat. No. 5,443,368, and a continuation-in-part of application No. 08/252,886, filed on Jun. 2, 1994, now Pat. No. 5,450,316, which is a division of application No. 07/944,040, filed on Sep. 11, 1992, now Pat. No. 5,343,708, which is a division of application No. 07/704,664, filed on May 20, 1991, now Pat. No. 5,157,928, which is a continuation of application No. 07/461,534, filed on Jan. 5, 1990, now abandoned, which is a division of application No. 07/243,707, filed on Sep. 13, 1988, now Pat. No. 4,918,930.

(51) Int. Cl.
*B01D 8/00* (2006.01)

(52) U.S. Cl. ..... 62/55.5

(58) Field of Classification Search ..... 62/55.5, 62/176.6

See application file for complete search history.

(56) References Cited

U.S. PATENT DOCUMENTS 3,832,084 A 8/1974 Maurice (Continued)

FOREIGN PATENT DOCUMENTS

CH 652 805 A5 11/1985

(Continued)

OTHER PUBLICATIONS

Sheats and Halverson, "State of the Art Microprocessor Technology Applied to Cryogenic Temperature Readout and Control," Cryogenic Conference, San Diego, CA 1981, pp. 1183-1188.

(Continued)

*Primary Examiner*—Melvin Jones
(74) *Attorney, Agent, or Firm*—Hamilton, Brook, Smith & Reynolds, P.C.

(57) ABSTRACT

An electronic controller maintains the operating temperature of a cryopump by controlling a heater coupled to the cryopump. The heater is coupled to a cryopumping surface of the cryopump. The controller can control the operation of the heater in response to feedback from temperature sensors coupled to the cryopump. The controller can cause the heater to shut-off if a temperature sensor reads out of its normal temperature range.

19 Claims, 31 Drawing Sheets

U.S. PATENT DOCUMENTS

| | | | | |
|---|---|---|---|---|
| 4,354,356 | A | | 10/1982 | Milner |
| 4,361,418 | A | | 11/1982 | Tscheppe |
| 4,412,851 | A | | 11/1983 | Laine |
| 4,438,632 | A | | 3/1984 | Lessard et al. |
| 4,546,613 | A | | 10/1985 | Eacobacci et al. |
| 4,602,642 | A | | 7/1986 | O'Hara et al. |
| 4,614,093 | A | | 9/1986 | Bachler et al. |
| 4,633,672 | A | | 1/1987 | Persem et al. |
| 4,667,477 | A | | 5/1987 | Matsuda et al. |
| 4,679,401 | A | | 7/1987 | Lessard et al. |
| 4,688,261 | A | | 8/1987 | Killoway et al. |
| 4,709,579 | A | | 12/1987 | Parker et al. |
| 4,718,240 | A | * | 1/1988 | Andeen et al. ..... 62/55.5 |
| 4,724,677 | A | | 2/1988 | Foster |
| 4,735,084 | A | | 4/1988 | Fruzzetti |
| 4,757,689 | A | * | 7/1988 | Bachler et al. ..... 62/55.5 |
| 4,829,774 | A | | 5/1989 | Wassibauer et al. |
| 4,873,833 | A | | 10/1989 | Pfeiffer et al. |
| 4,918,930 | A | | 4/1990 | Gaudet et al. |
| 4,919,599 | A | | 4/1990 | Reich et al. |
| 4,926,648 | A | | 5/1990 | Okumura et al. |
| 4,953,359 | A | | 9/1990 | Forth et al. |
| 4,958,499 | A | | 9/1990 | Haefner et al. |
| 5,060,263 | A | | 10/1991 | Bosen et al. |
| 5,062,271 | A | | 11/1991 | Okumura et al. |
| 5,062,771 | A | | 11/1991 | Satou et al. |
| 5,114,316 | A | | 5/1992 | Shimizu |
| 5,157,928 | A | | 10/1992 | Gaudet et al. |
| 5,209,631 | A | | 5/1993 | Bernhardt |
| 5,222,135 | A | | 6/1993 | Hardy et al. |
| 5,265,431 | A | | 11/1993 | Gaudet et al. |
| 5,323,465 | A | | 6/1994 | Avarne |
| 5,343,708 | A | | 9/1994 | Gaudet et al. |
| 5,348,448 | A | | 9/1994 | Ikemoto et al. |
| 5,398,543 | A | | 3/1995 | Fukushima et al. |
| 5,443,368 | A | | 8/1995 | Weeks et al. |
| 5,517,823 | A | | 5/1996 | Andeen et al. |
| 5,542,828 | A | | 8/1996 | Grenci et al. |
| 5,575,853 | A | | 11/1996 | Arami et al. |
| 5,582,017 | A | | 12/1996 | Noji et al. |
| 5,678,759 | A | | 10/1997 | Grenci et al. |
| 6,022,195 | A | | 2/2000 | Gaudet et al. |

FOREIGN PATENT DOCUMENTS

| | | |
|---|---|---|
| EP | 0233784 A2 | 8/1987 |
| GB | 2 065 782 | 7/1981 |
| JP | 2-204696 | 8/1990 |
| JP | 403107599 | 5/1991 |
| JP | 403182698 | 8/1991 |
| JP | 4-164188 | 6/1992 |

OTHER PUBLICATIONS

Finley, "Automatic regeneration of multiple cryopumps," *J. Vac. Sci. Technology*, A4(3), May/Jun. 1986, pp. 310-313.
Temescal product description, Sep. 1982.
Peterson, John F., "Cryopump Regeneration for Optimized Uptime," *Solid State Technology*, Apr. 1986, pp. 199-201.
Longsworth, R.C., et al., "Cryopump regeneration studies," *J. Vac. Sci. Technology*, 21(4), Nov./Dec. 1982, pp. 1022-1027.
Peterson, John F. et al., "Vacuum Pump Technology; A Short Course on Theory and Operations," *Solid State Technology*, Jan. 1982, pp. 104-110.
Sievert, Reinhard, "Regenerating Refrigerator-Cryopumps Cooled," *Solid State Technology*, May 1986, pp. 90-92.
Singer, Peter H., "Update on Cryogenic Pumps," *Semiconductor International*, Oct. 1982, pp. 89-99.
Ehmann, John, "Regeneration of High-Vacuum Cryopumps," *Solid State Technology*, Apr. 1982, pp. 235-239.
Brown, Thomas, et al., "Microcomputer Applications in the Space Simulation Laboratory," *Proceedings- Institute of Environmental Sciences*, 1983, pp. 179-188.
Sheats, David C., et al., "Microprocessor-Based Cryopump Controller," Cryogenic Conference, Aug. 15-19. 1983.
Pamphlet, "Cryopumping," CTI-Cryogenics, 1986, 4 pages.
Brochure, "ATP 1500M, Magnetically Levitated Turbomolecular Pump," Alcatel CIT Industries Division, Apr. 1992, pp. 1-4.
O'Hanlon, John F., *A User's Guide to Vacuum Technology*, Second Edition, Chapter 11, "Turbomolecular Pumps," 1989, pp. 181-195.
O'Hanlon, John F., *A User's Guide to Vacuum Technology*, Second Edition, Section 19.2, "Turbomolecular-Pumped Systems," 1989, pp. 361-368.
O'Hanlon, John F., *A User's Guide to Vacuum Technology*, Second Edition, Section 20.2.2, "Turbomolecular Pumps," 1989, pp. 393-394.

* cited by examiner

CRYOPUMP TEMPERATURE CONTROL OF ARRAYS

RELATED APPLICATIONS

This application is a continuation of U.S. application Ser. No. 10/225,485, filed Aug. 20, 2002, now U.S. Pat. No. 6,755,028, which is a continuation of application Ser. No. 09/977,559, filed Oct. 15, 2001, and now U.S. Pat No. 6,460,351, which is a continuation of application Ser. No. 09/826,692, filed Apr. 5, 2001, now U.S. Pat. No. 6,318,093, which is a continuation of application Ser. No. 09/454,358, filed Dec. 3, 1999, now U.S. Pat. No. 6,461,113, which is a continuation of Ser. No. 08/517,091, filed Aug. 21, 1995, now U.S. Pat. No. 6,022,195, which is a Continuation-In-Part of Ser. No. 08/092,692, filed Jul. 16, 1993, now U.S. Pat. No. 5,443,368 and a Continuation-In-Part application of Ser. No. 08/252,886, filed Jun. 2, 1994, now U.S. Pat. No. 5,450,316 which is a Divisional of Ser. No. 07/944,040, filed Sep. 11, 1992, now U.S. Pat. No. 5,343,708, which is a Divisional of Ser. No. 07/704,664, filed May 20, 1991, now U.S. Pat. No. 5,157,928, which is a File Wrapper Continuation of Ser. No. 07/461,534, filed Jan. 5, 1990, now abandoned, which is a Divisional of Ser. No. 07/243,707 filed Sep. 13, 1988, now U.S. Pat. No. 4,918,930, the entire teaching of which are incorporated herein by reference.

BACKGROUND OF THE INVENTION

Cryogenic vacuum pumps, or cryopumps, currently available generally follow a common design concept. A low temperature array, usually operating in the range of 4 to 25K, is the primary pumping surface. This surface is surrounded by a higher temperature radiation shield, usually operated in the temperature range of 60 to 130K, which provides radiation shielding to the lower temperature array. The radiation shield generally comprises a housing which is closed except at a frontal array positioned between the primary pumping surface and a work chamber to be evacuated.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, only a vacuum remains in the work chamber.

In systems cooled by closed cycle coolers, the cooler is typically a two-stage refrigerator having a cold finger which extends through the rear or side of the radiation shield. High pressure helium refrigerant is generally delivered to the cryocooler through high pressure lines from a compressor assembly. Electrical power to a displacer drive motor in the cooler is usually also delivered through the compressor.

The cold end of the second, coldest stage of the cryocooler is at the tip of the cold finger. The primary pumping surface, or cryopanel, is connected to a heat sink at the coldest end of the second stage of the cold finger. This cryopanel may be a simple metal plate or cup or an array of metal baffles arranged around and connected to the second-stage heat sink. This second-stage cryopanel also supports the low temperature adsorbent.

The radiation shield is connected to a heat sink, or heat station, at the coldest end of the first stage of the refrigerator.

The shield surrounds the second-stage cryopanel in such a way as to protect it from radiant heat. The frontal array is cooled by the first-stage heat sink through the side shield or, as disclosed in U.S. Pat. No. 4,356,701, through thermal struts.

After several days or weeks of use, the gases which have condensed onto the cryopanels, and in particular the gases which are adsorbed, begin to saturate the cryopump. A regeneration procedure must then be followed to warm the cryopump and thus release the gases and remove the gases from the system. As the gases evaporate, the pressure in the cryopump increases, and the gases are exhausted through a relief valve. During regeneration, the cryopump is often purged with warm nitrogen gas. The nitrogen gas hastens warming of the cryopanels and also serves to flush water and other vapors from the cryopump. By directing the nitrogen into the system close to the second-stage array, the nitrogen gas which flows outward to the exhaust port minimizes the movement of water vapor from the first array back to the second-stage array. Nitrogen is the usual purge gas because it is inert and is available free of water vapor. It is usually delivered from a nitrogen storage bottle through a fluid line and a purge valve coupled to the cryopump.

After the cryopump is purged, it must be rough pumped to produce a vacuum about the cryopumping surfaces and cold finger to reduce heat transfer by gas conduction and thus enable the cryocooler to cool to normal operating temperatures. The rough pump is generally a mechanical pump coupled through a fluid line to a roughing valve mounted to the cryopump.

Control of the regeneration process is facilitated by temperature gauges coupled to the cold finger heat stations. Thermocouple pressure gauges have also been used with cryopumps but have generally not been recommended because of a potential of igniting gases released in the cryopump by a spark from the current-carrying thermocouple. The temperature and/or pressure sensors mounted to the pump are coupled through electrical leads to temperature and/or pressure indicators.

Although regeneration may be controlled by manually turning the cryocooler off and on and manually controlling the purge and roughing valves, a separate regeneration controller is used in more sophisticated systems. Leads from the controller are coupled to each of the sensors, the cryocooler motor and the valves to be actuated.

SUMMARY OF THE INVENTION

The present invention relates to maintaining the operating temperature of a cryopump. A heater is coupled to a cryopumping surface of the cryopump. Preferably, the heater is mounted integrally with the cryopumping arrays. The heater is controlled during the operation of the cryopump in order to maintain the temperature of the cryopump.

The cryopump may include first and second stage arrays. Each array may include a heater mount. The heaters may be controlled by feedback from one or more temperature sensors coupled to the cryopump. The temperature sensors may be temperature sensing diodes. The heaters may be controlled proportionally by feedback from the temperature sensing diodes. The heaters may be shut-off when a diode reads outside of its normal temperature range. If the diode reads outside of its normal range, the system may assume that the diode is defective and alert the user.

A heater coupled to the first stage of the cryopump may maintain the temperature of the first stage. The temperature may be maintained above 65K.

An electronic controller may be used to control the cryopump. Preferably, the controller is mounted in a housing of a module that is adapted to be removably coupled to the cryopump. The electronic module may store system parameters such as temperature, pressure and regeneration times. Preferably, the electronic module includes a nonvolatile random access memory so that the parameters are retained even with loss of power or removal of the module of the cryopump.

The heater may include several levels of interlocks and control mechanisms. For instance, there may be a limit on the maximum temperature that the heater can reach, for safety. The heating elements may be made with special temperature limiting wire. This can limit the maximum temperature the heaters reach if all control is lost. The electrical wires and heating elements may be hermetically sealed. The heater may include a tube which hermetically seals electric heating units. This can prevent any potential sparks in the vacuum vessel due to broken wires or bad connections.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts through different views. The drawings are not necessarily to scale, emphasis being placed instead upon illustrating the principles of the invention.

DETAILED DESCRIPTION OF THE INVENTION

A description of preferred embodiments of the invention follows.

Figure 1:
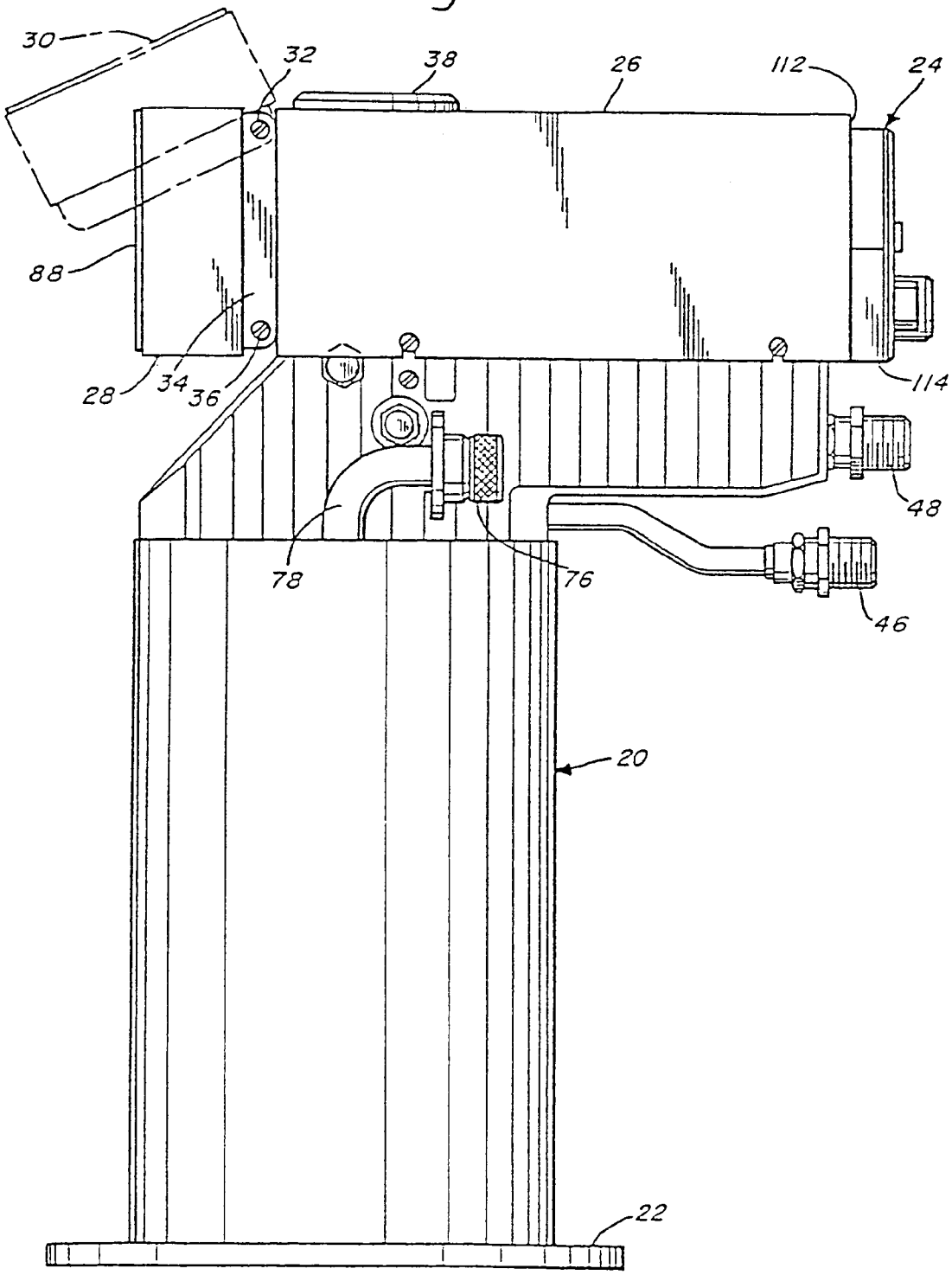
FIG. 1 is a side view of a cryopump embodying the present invention.

FIG. 1 is an illustration of a cryopump embodying the present invention. The cryopump includes the usual vacuum vessel 20 which has a flange 22 to mount the pump to a system to be evacuated. In accordance with the present invention, the cryopump includes an electronic module 24 in a housing 26 at one end of the vessel 20. A control pad 28 is pivotally mounted to one end of the housing 26. As shown by broken lines 30, the control pad may be pivoted about a pin 32 to provide convenient viewing. The pad bracket 34 has additional holes 36 at the opposite end thereof so that the control pad can be inverted where the cryopump is to be mounted in an orientation inverted from that shown in FIG. 1. Also, an elastomeric foot 38 is provided on the flat upper surface of the electronics housing 26 to support the pump when inverted.

Figure 2:
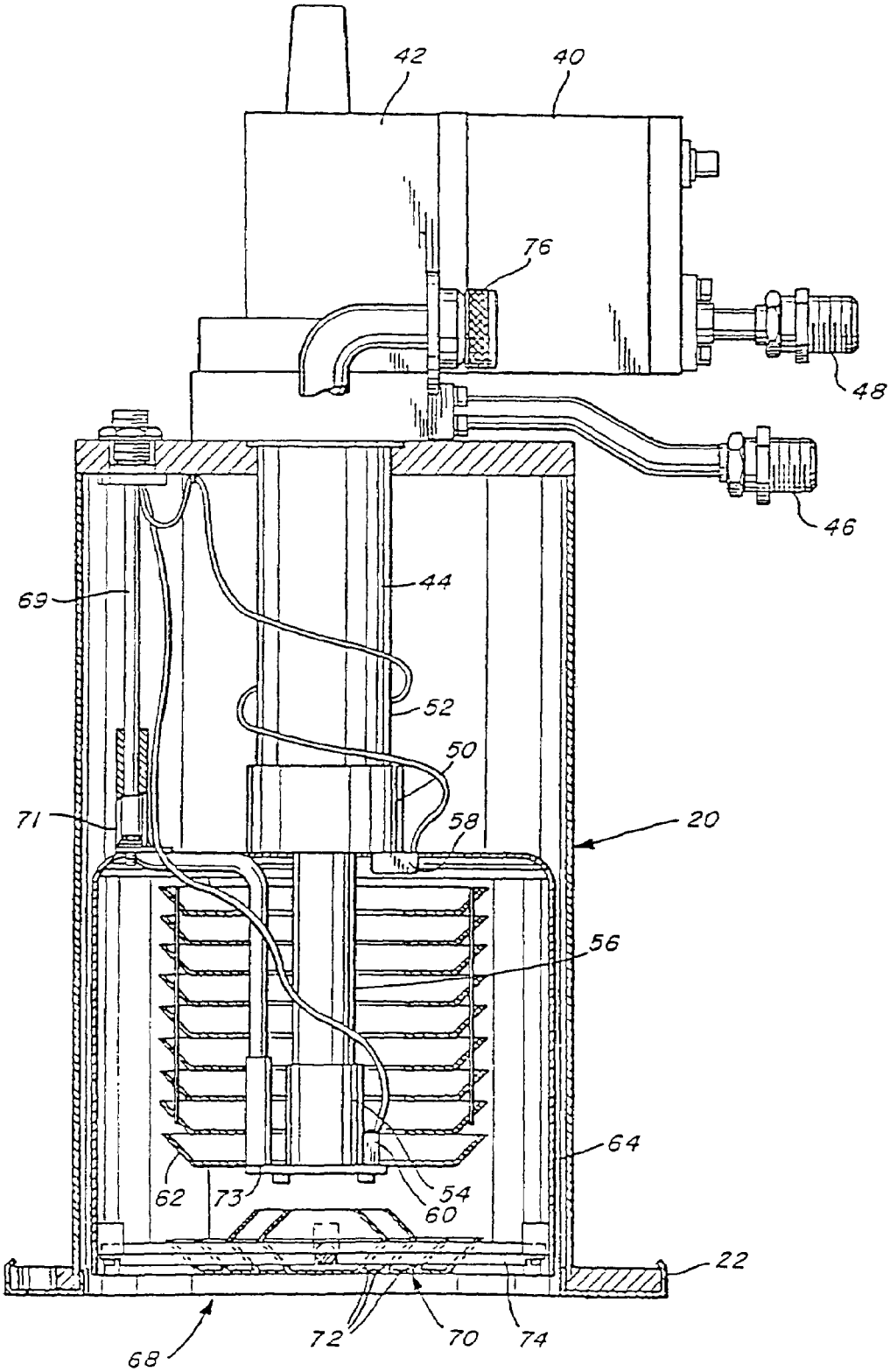
FIG. 2 is a cross-sectional view of the cryopump of FIG. 1 with the electronic module and housing removed.

As illustrated in FIG. 2, much of the cryopump is conventional. In FIG. 2, the housing 26 is removed to expose a drive motor 40 and a crosshead assembly 42. The crosshead converts—the rotary motion of the motor 40 to reciprocating motion to drive a displacer within the two-stage cold finger 44. With each cycle, helium gas introduced into the cold finger under pressure through line 46 is expanded and thus cooled to maintain the cold finger at cryogenic temperatures. Helium then warmed by a heat exchange matrix in the displacer is exhausted through line 48.

A first-stage heat station 50 is mounted at the cold end of the first stage 52 of the refrigerator. Similarly, heat station 54 is mounted to the cold end of the second stage 56. Suitable temperature sensor elements 58 and 60 are mounted to the rear of the heat stations 50 and 54.

The primary pumping surface is a cryopanel array 62 mounted to the heat sink 54. This array comprises a plurality of disks as disclosed in U.S. Pat. No. 4,555,907. Low temperature adsorbent is mounted to protected surfaces of the array 62 to adsorb noncondensible gases.

A cup-shaped radiation shield 64 is mounted to the first stage heat station 50. The second stage of the cold finger extends through an opening in that radiation shield. This radiation shield 64 surrounds the primary cryopanel array to the rear and sides to minimize heating of the primary cryopanel array by radiation. The temperature of the radiation shield may range from as low as 40K at the heat sink 50 to as high as 130K adjacent to the opening 68 to an evacuated chamber.

A frontal cryopanel array 70 serves as both a radiation shield for the primary cryopanel array and as a cryopumping surface for higher boiling temperature gases such as water vapor. This panel comprises a circular array of concentric louvers and chevrons 72 joined by a spoke-like plate 74. The configuration of this cryopanel 70 need not be confined to circular, concentric components; but it should be so arranged as to act as a radiant heat shield and a higher temperature cryopumping panel while providing a path for lower boiling temperature gases to the primary cryopanel.

Figure 3:
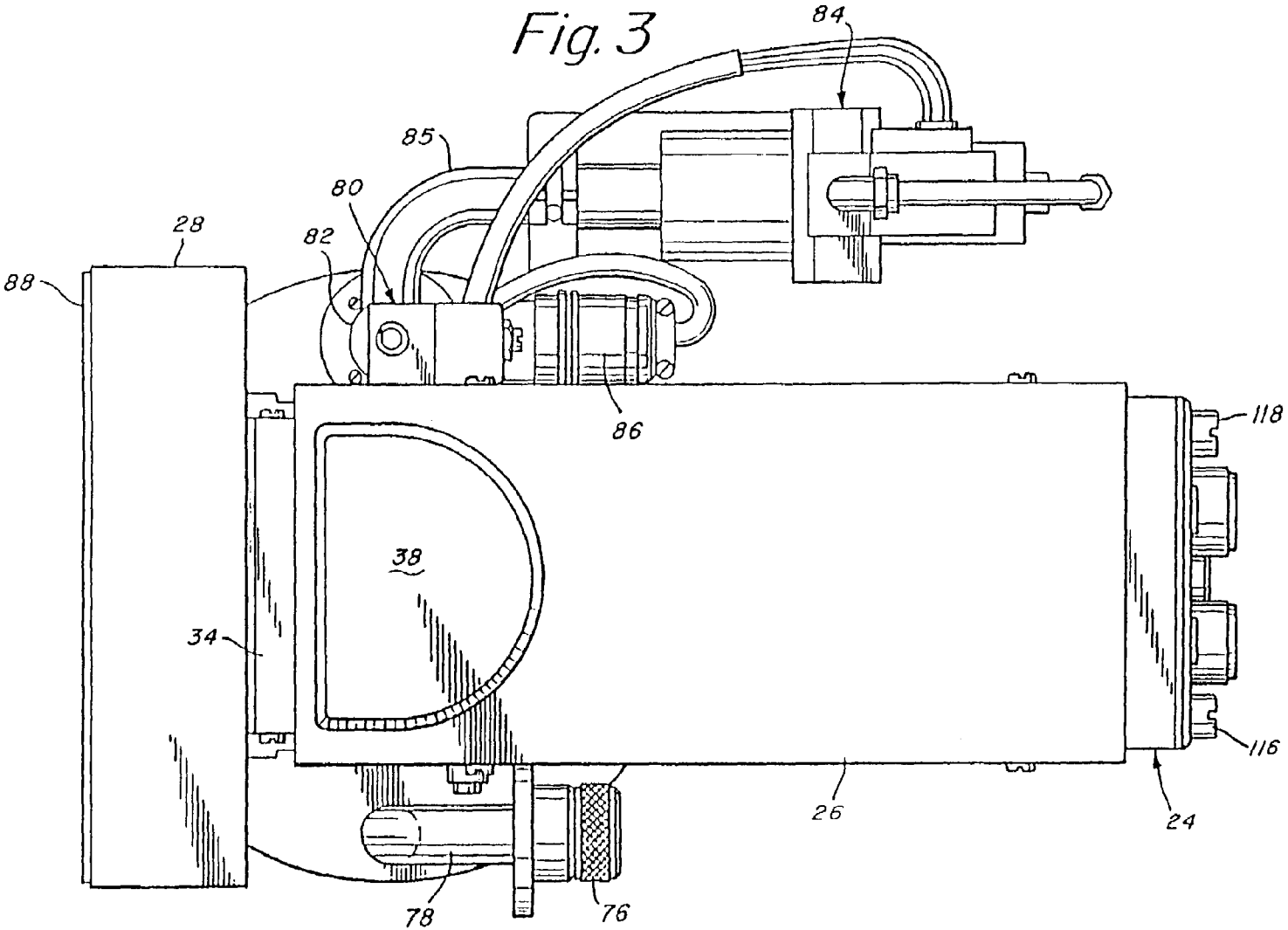
FIG. 3 is a top view of the cryopump of FIG. 1.

As illustrated in FIGS. 1 and 3, a pressure relief valve 76 is coupled to the vacuum vessel 20 through an elbow 78. To the other side of the motor and the electronics housing 26, as illustrated in FIG. 3, is an electrically actuated purge valve 80 mounted to the housing 20 through a vertical pipe 82. Also coupled to the housing 20 through the pipe 82 is an electrically actuated roughing valve 84. The valve 84 is coupled to the pipe 82 through an elbow 85. Finally, a thermocouple vacuum pressure gauge 86 is coupled to the interior of the chamber 20 through the pipe 82.

Less conventional in the cryopump is a heater assembly 69 illustrated in FIG. 2. The heater assembly includes a tube which hermetically seals electric heating units. The heating units heat the first stage through a heater mount 71 and a second stage through a heater mount 73.

For safety, the heater has several levels of interlocks and control mechanisms. They are as follows: (1) The electrical wires and heating elements are hermetically sealed. This prevents any potential sparks in the vacuum vessel due to broken wires or bad connections. (2) The heating elements are made with special temperature limiting wire. This limits the maximum temperature the heaters can reach if all control is lost. (3) The heaters are proportionally controlled by feedback from the temperature sensing diodes. Thus, heat is called for only when needed. (4) When used for temperature control of the arrays or heat station, the maximum power level is held at 25%. (5) If the diode reads out of its normal range, the system assumes that it is defective, shuts off the heaters, and warns the user. (6) The heaters are switched on and off through two relays in series. One set of relays are solid state and the other are mechanical. The solid state relays are used to switch the power when in the temperature control mode. The mechanical relays are part of the safety control and switch off all power to both heaters if a measured temperature, or a diode, goes out of specification. (7) The electronics have in them a watchdog timer. This device has to be reset ten times a second. Thus, if the software program (which contains the heater control software) fails to properly recycle, the timer will not be reset. If it is not reset, it shuts off everything, and then reboots the system.

As will be discussed in greater detail below, the refrigerator motor 40, cryopanel heater assembly 69, purge valve 80 and roughing valve 84 are all controlled by the electronic module. Also, the module monitors the temperature detected by temperature sensors 58 and 60 and the pressure sensed by the TC pressure gauge 86.

Figure 4:
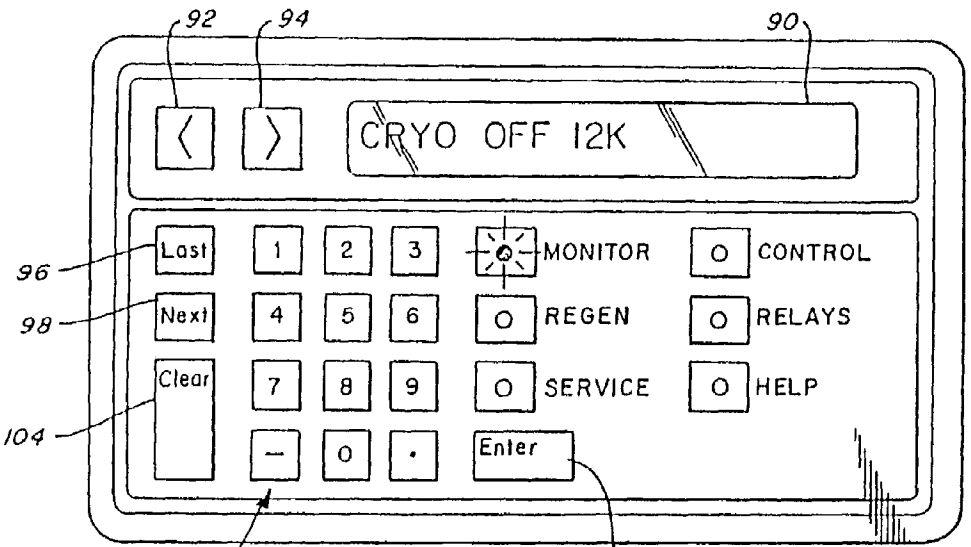
FIG. 4 is a view of the control panel of the cryopump of FIGS. 1 and 3.

The control pad 28 has a hinged cover plate 88 which, when opened, exposes a keyboard and display illustrated in FIG. 4. The control pad provides the means for programming, controlling and monitoring all cryopump functions. It includes an alphanumeric display 90 which displays up to sixteen characters. Longer messages can be accessed by the horizontal scroll display keys 92 and 94. Additional lines of messages and menu items may be displayed by the vertical scroll display keys 96 and 98. Numerical data may be input to the system by keys 100. The ENTER and CLEAR keys 102 and 104 are used to enter and clear data during programming. A MONITOR function key allows the display of sensor data and on/off status of the pump and relays. A CONTROL function key allows the operator to control various on and off functions. The RELAYS function key allows the operator to program the opening and closing of two set point relays. The REGEN function key activates a complete cryopump regeneration cycle, allows regeneration program changes and sets power failure recovery parameters. The SERVICE function key causes service-type data to be displayed and allows the setting of a password and password lockout of other functions. The HELP function key provides additional information when used in conjunction with the other five keys. Further discussion of the operation of the system in response to the function keys is presented below.

Figure 5:
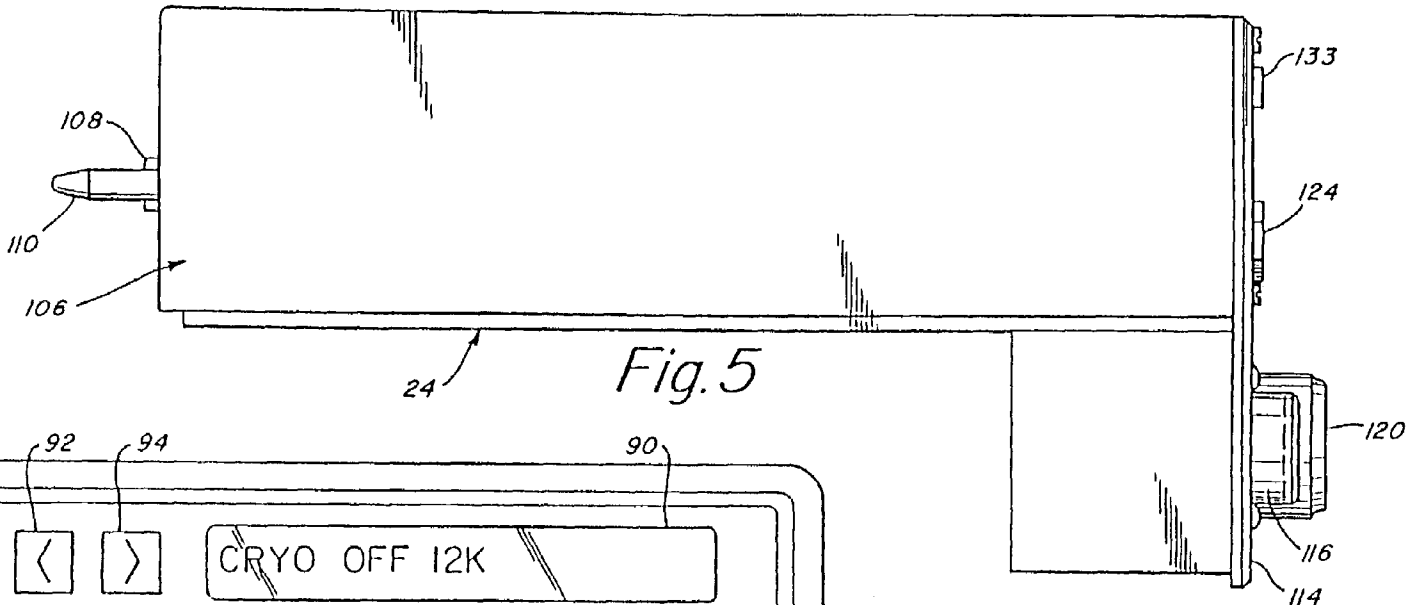
FIG. 5 is a side view of an electronic module removed from the cryopump of FIGS. 1 and 3.
Figure 6:
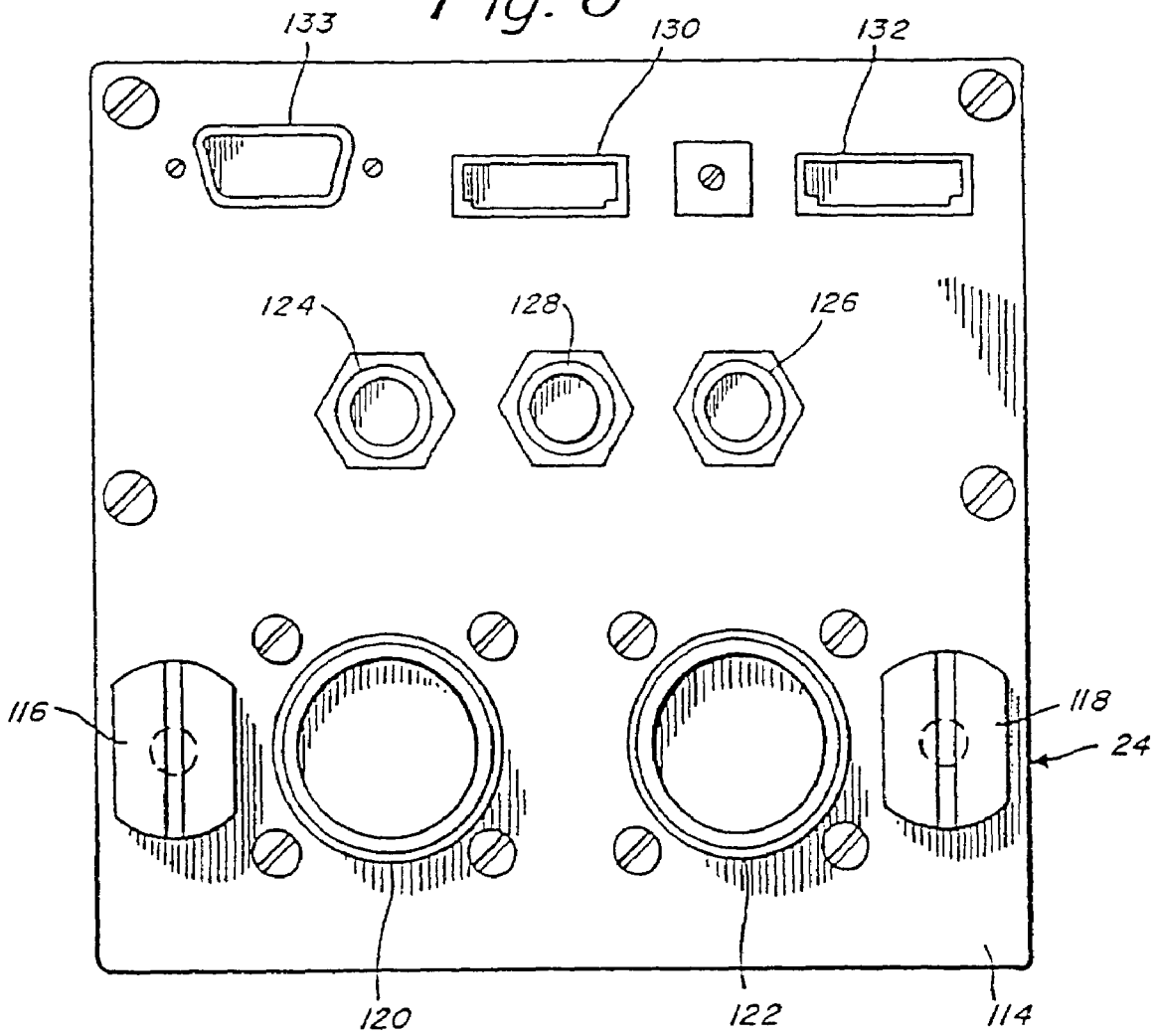
FIG. 6 is an end view of the module of FIG. 5.

In accordance with the present invention, all of the control electronics required to respond to the various sensors and control the refrigerator, heaters and valves is housed in a module 106 illustrated in FIG. 5. A control connector 108 is positioned at one end of the module housing. It is guided by a pair of pins 110 into association with a complementary connector within the permanently mounted housing 26. All electric access to the fixed elements of the cryopump is through this connector 108. The module 106 is inserted into the housing 26 through an end opening at 112 with the pins 110 leading. The opposite, external connection end 114 of the module is left exposed. That end is illustrated in FIG. 6.

Once the module is secured within the housing 26 by screws 116 and 118, power lines may be coupled to the input connector 120 and an output connector 122. The output connector allows a number of cryopumps to be connected in a daisy chain fashion as discussed below. Due to the elongated shape of the heads of the screws 116 and 118, those screws may not be removed until the power lines have been disconnected.

Also included in the end of the module is a connector 124 for controlling external devices through relays in the module and a connector 126 for receiving inputs from an auxiliary TC pressure sensor. A connector 128 allows a remote control pad to be coupled to the system. Connectors 130 and 132 are incoming and outgoing communications ports for coupling the pump into a network. An RS232 port 133 allows access and control from a remote computer terminal, directly or through a modem.

Figure 7:
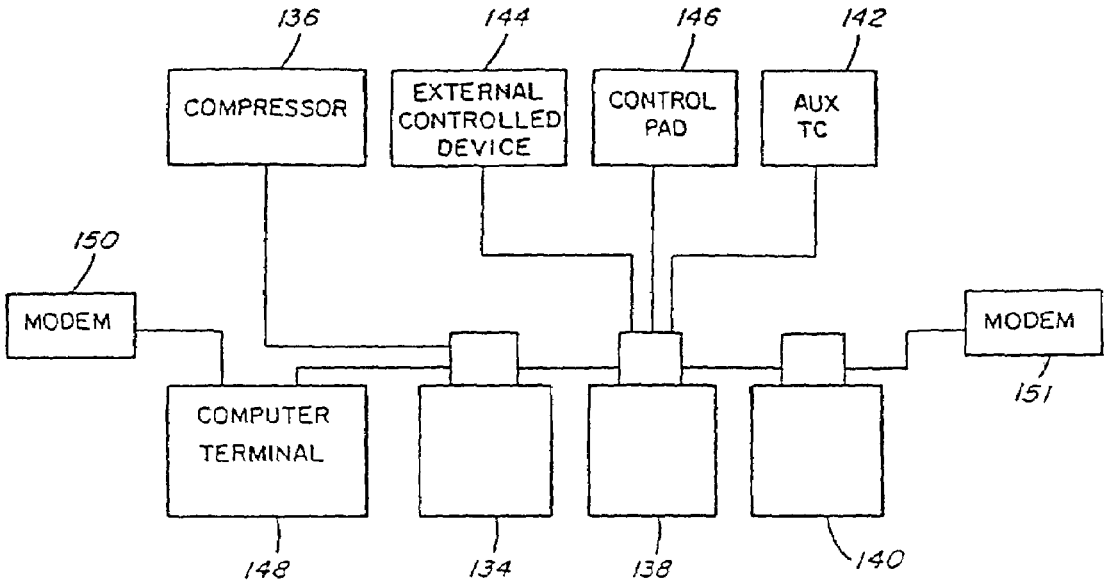
FIG. 7 is a schematic illustration of a system having three cryopumps of the present invention.

A typical network utilizing the cryopump of the present invention is illustrated in FIG. 7. A first pump 134 is coupled through its power input connector 120 to a system compressor 136. The gas inlet and outlet ports 46 and 48 are also coupled to the compressor gas lines. With the outlet connectors 122, the cryopump 134 may be coupled to power additional pumps 138 and 140. The cryopump may be coupled in a daisy chain communications network by the network connectors 130, 132. Each individual cryopump or the network of cryopumps illustrated in FIG. 7 may be coupled to a computer terminal 148 through the RS232 port. Further, each cryopump or the network may be coupled to a modem 150 and/or 151 for communication with a remote computer terminal. As illustrated by cryopump 138, each may additionally be coupled to an external sensor 142, and to other external devices 144 controlled by relays in the module. A remote control pad 146 identical to that illustrated in FIG. 4 may be used to control the cryopump. With such an arrangement, control may be either local through the control pad 28 or remote through the control pad 146.

Figure 8:
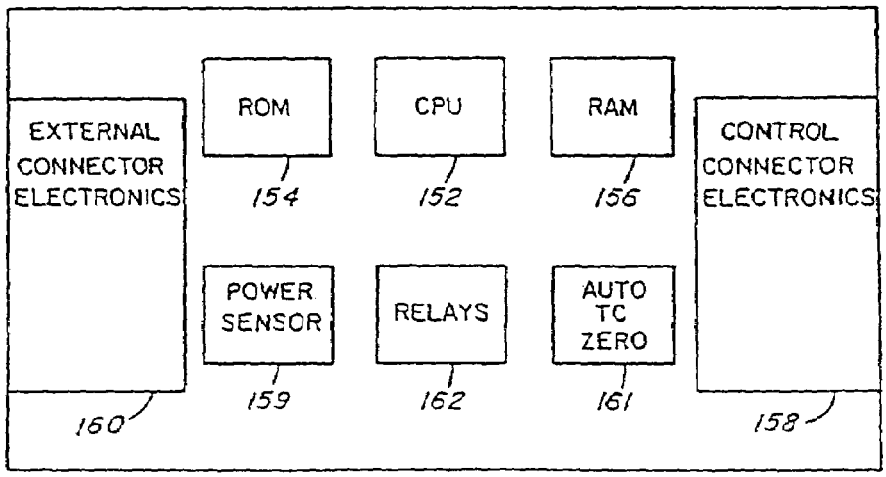
FIG. 8 is a schematic illustration of the electronics of the module of FIG. 5.
Figure 9A:
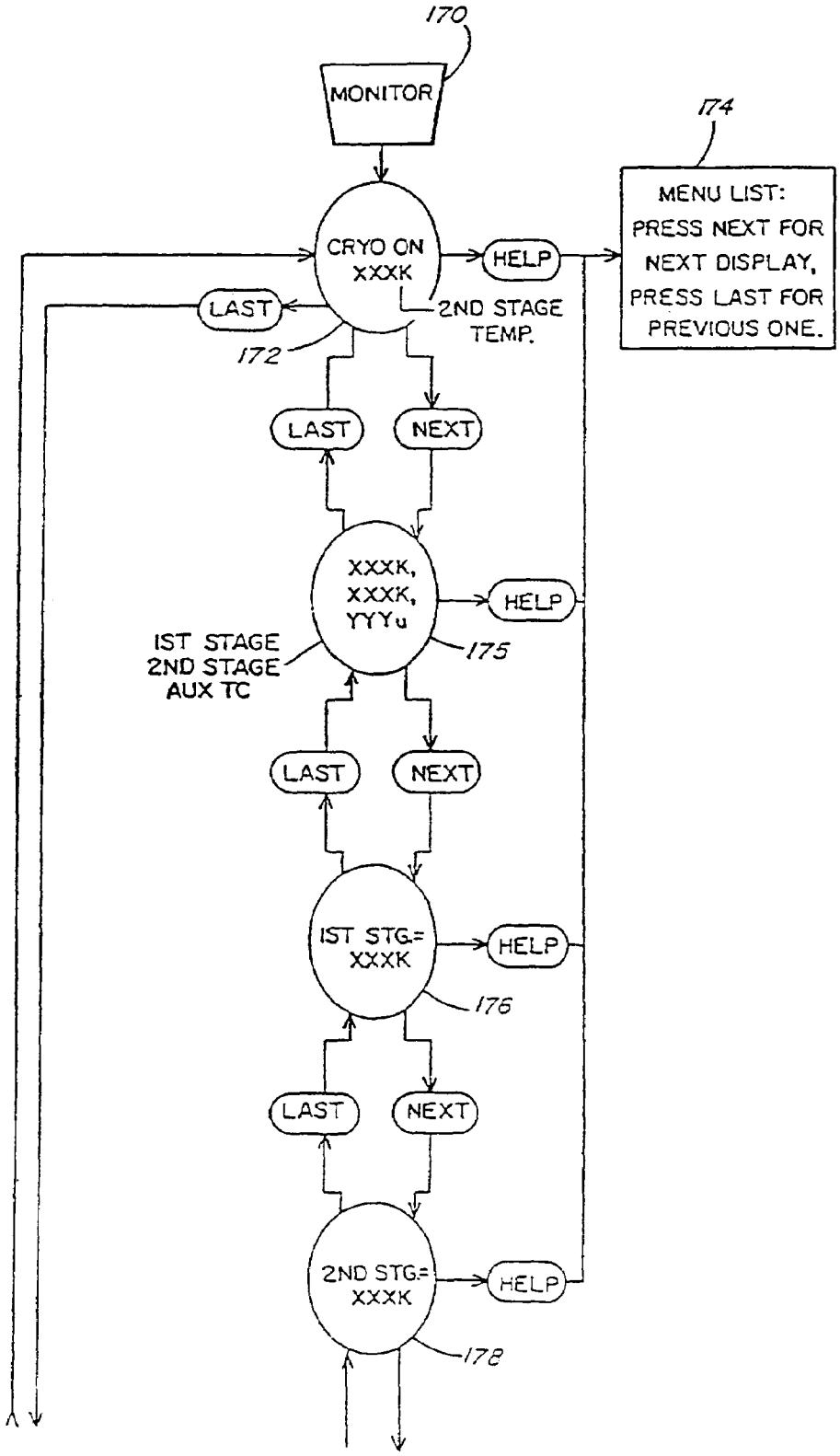
FIGS. 9A and 9B are a flowchart of the response of the system to keyboard inputs when the monitor function has been enabled.
Figure 9B:
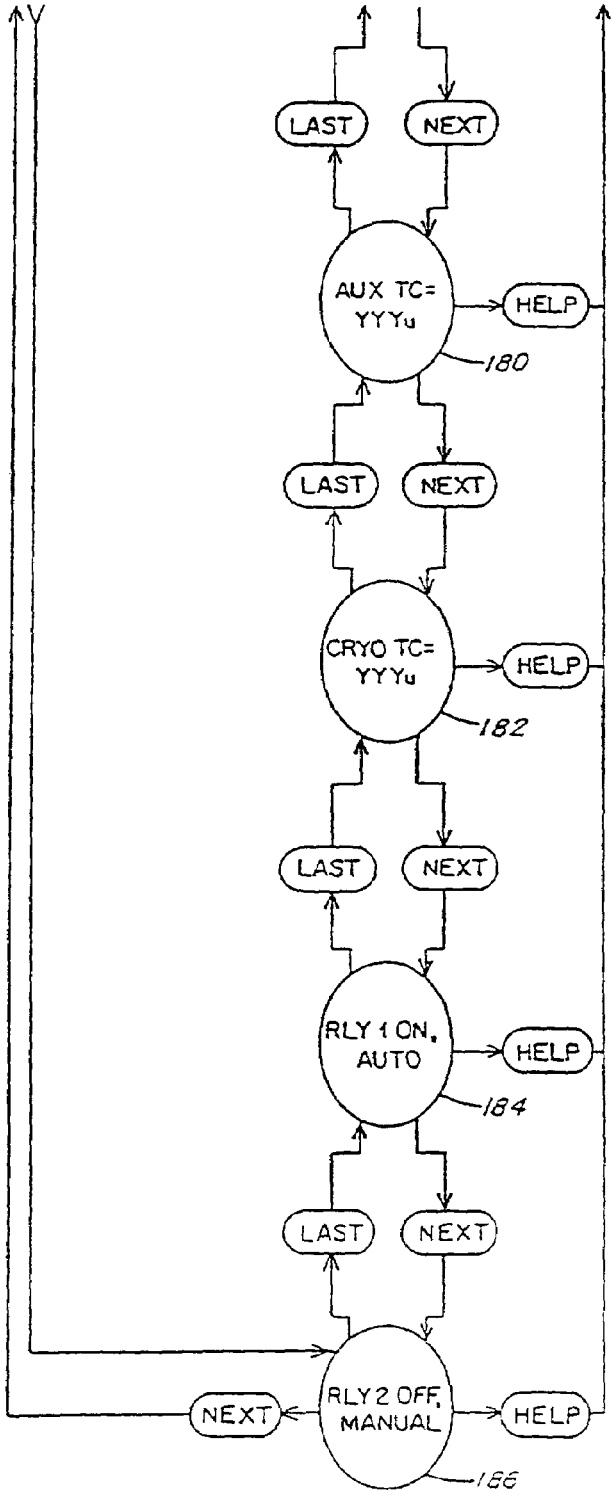
Figure 10A:
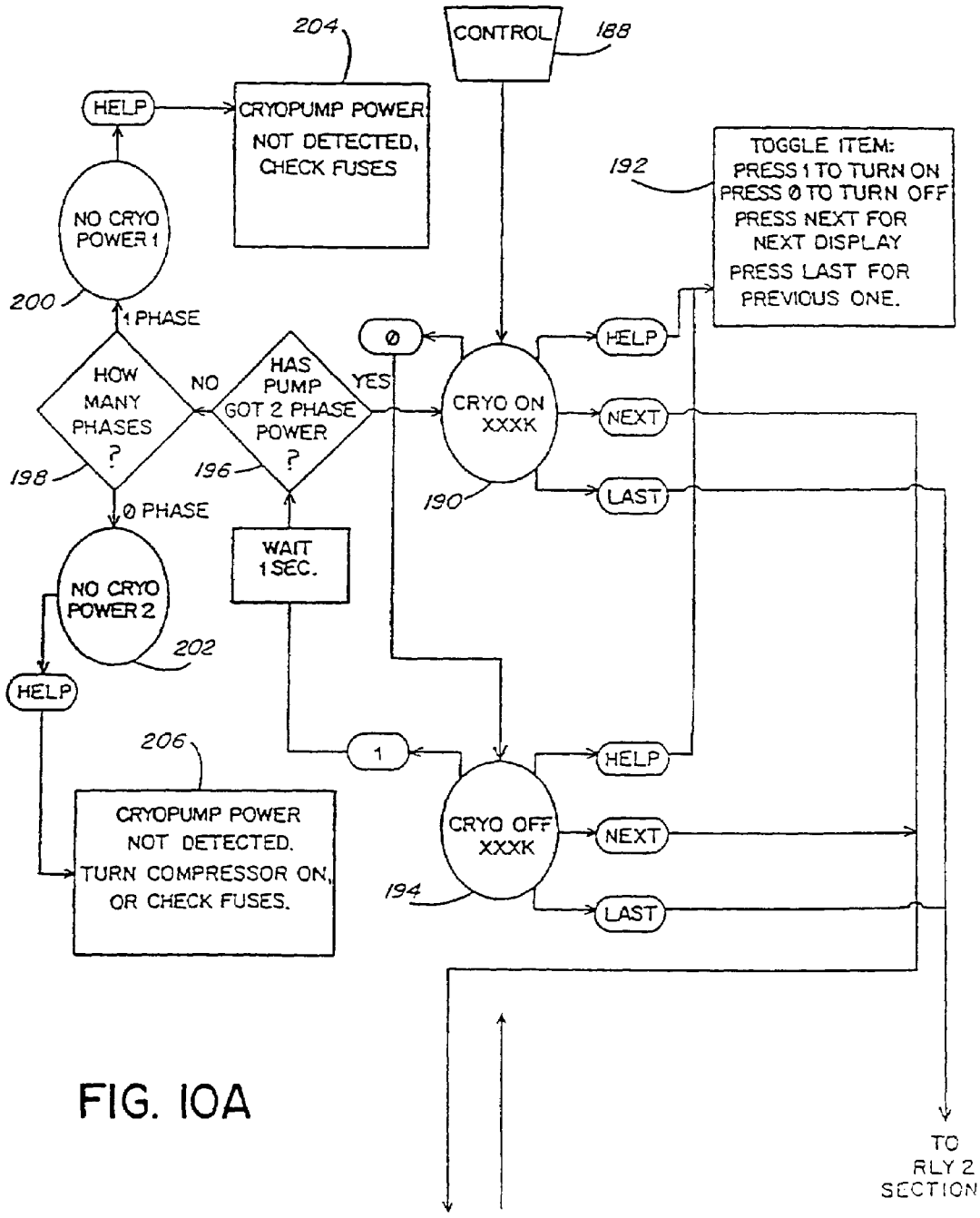
FIGS. 10A–10G are a flowchart of the response of the system to keyboard inputs when the control function has been enabled.
Figure 10B:
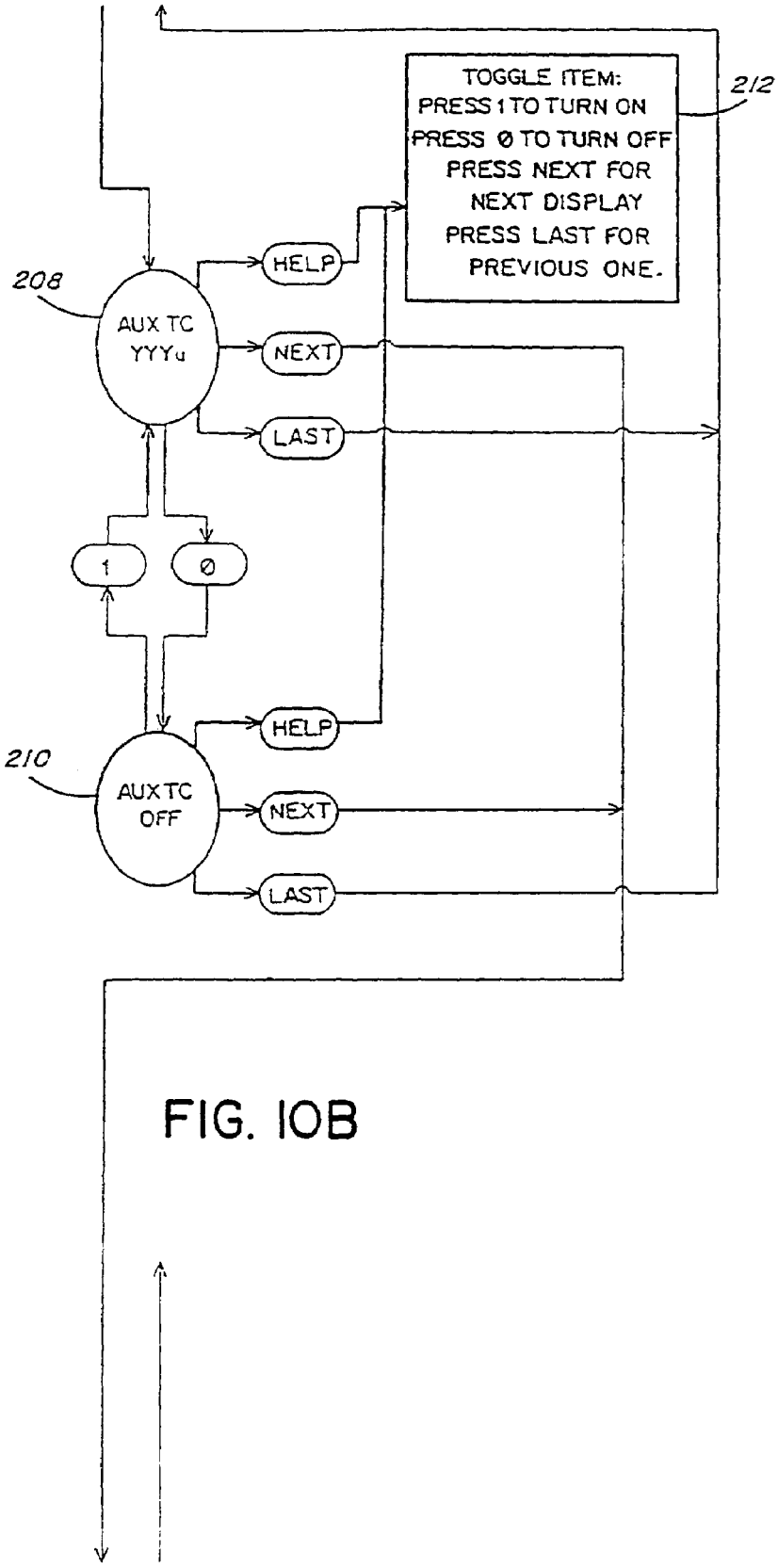
Figure 10C:
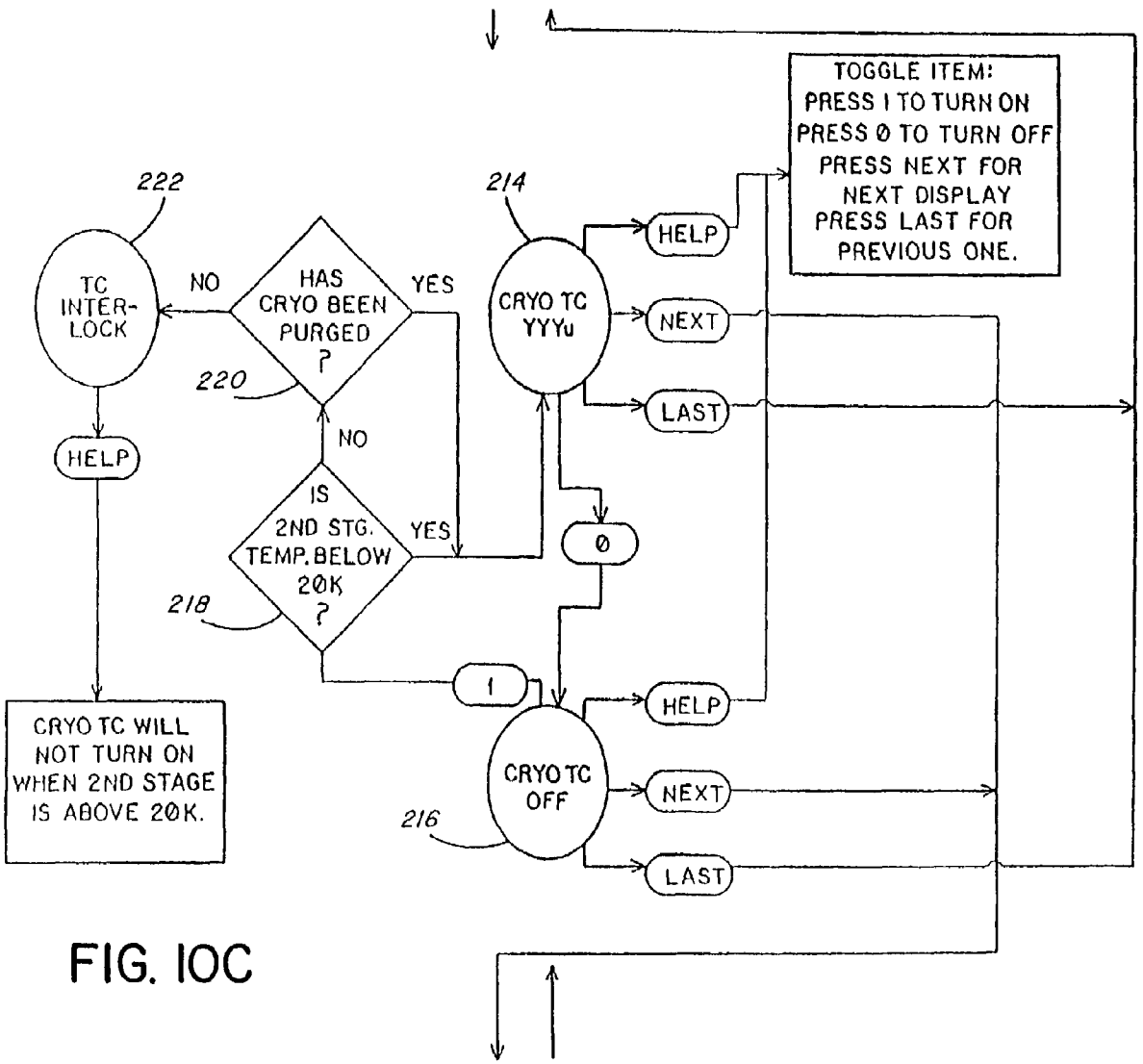
Figure 10D:
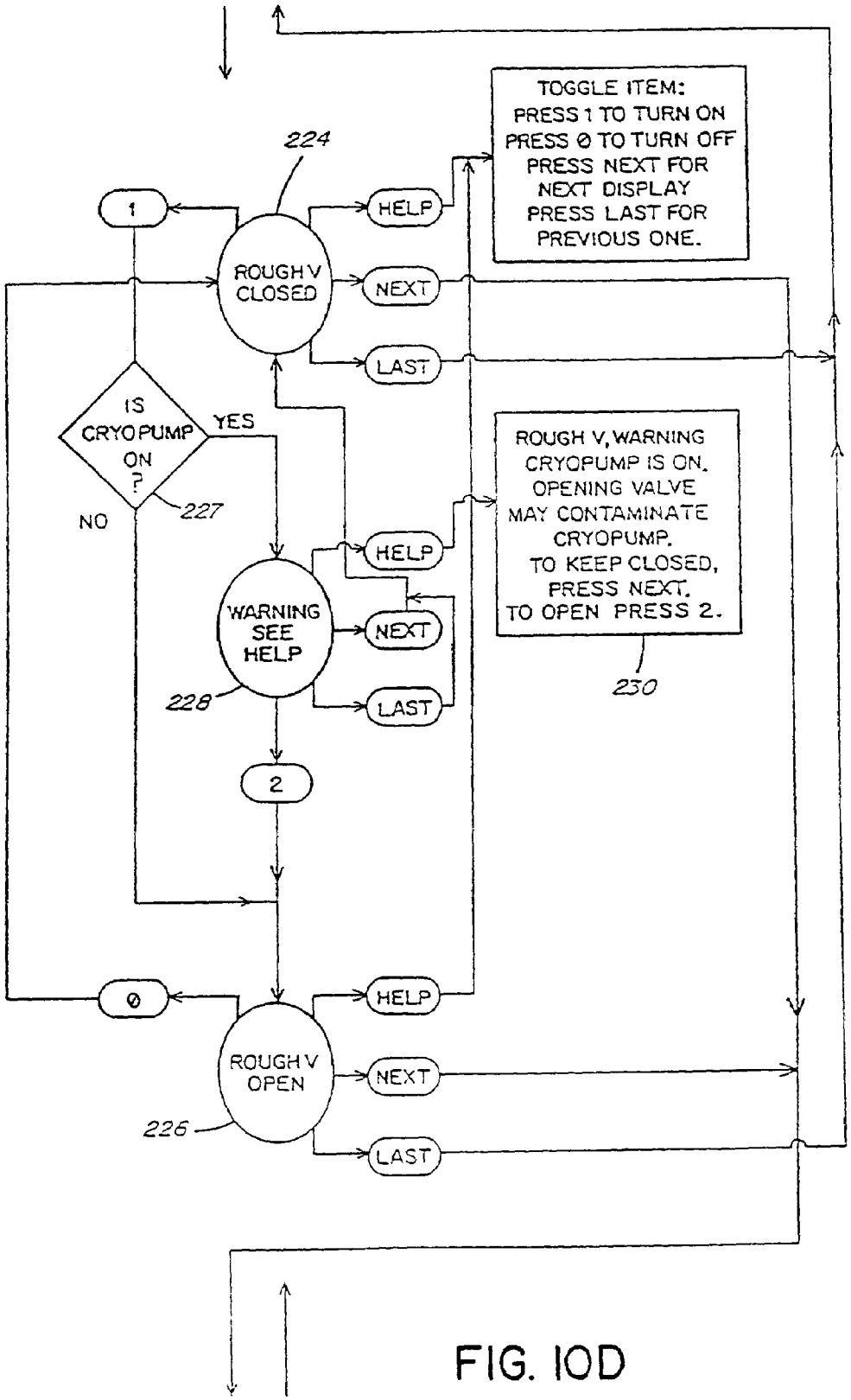
Figure 10E:
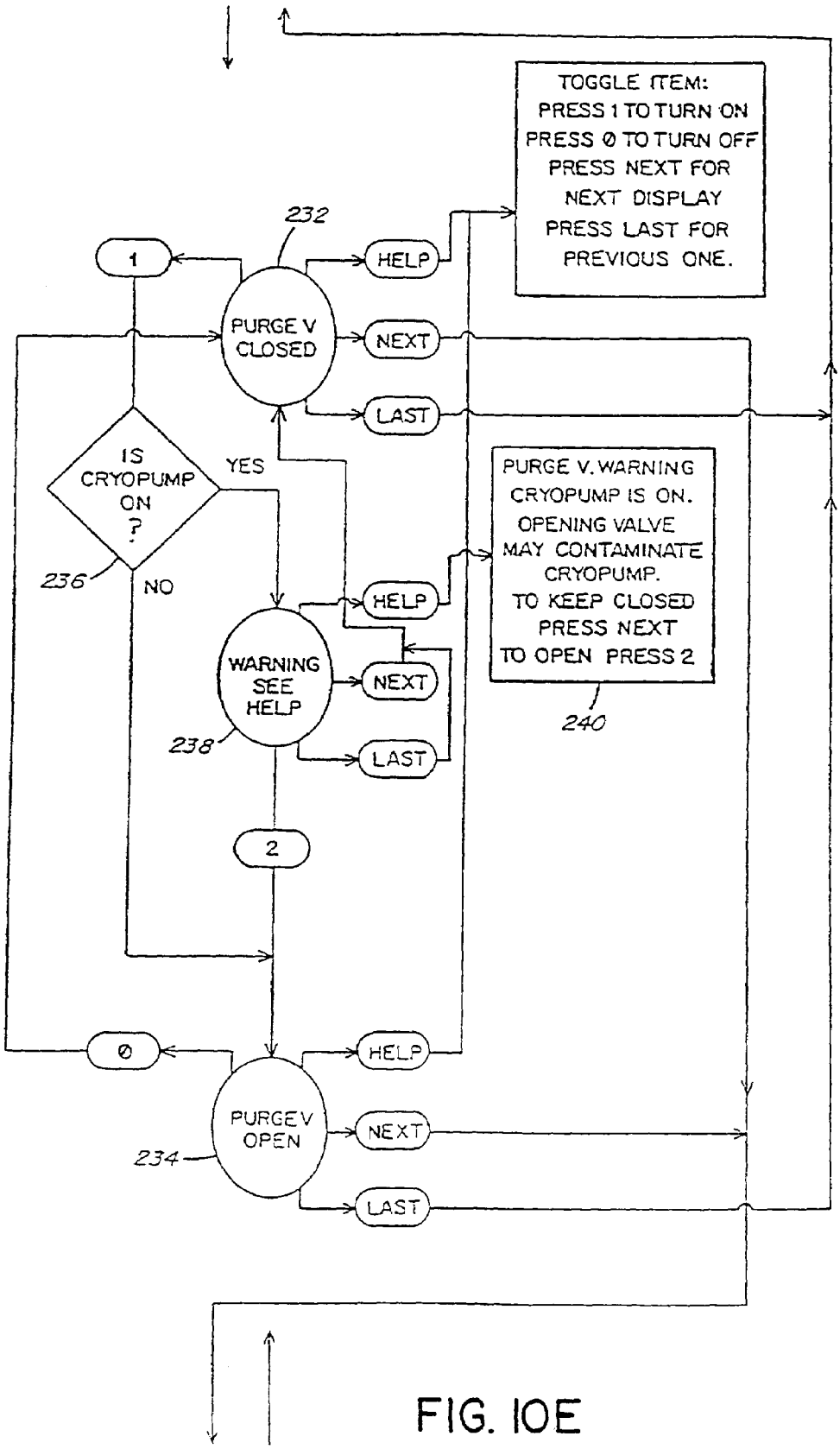
Figure 10F:
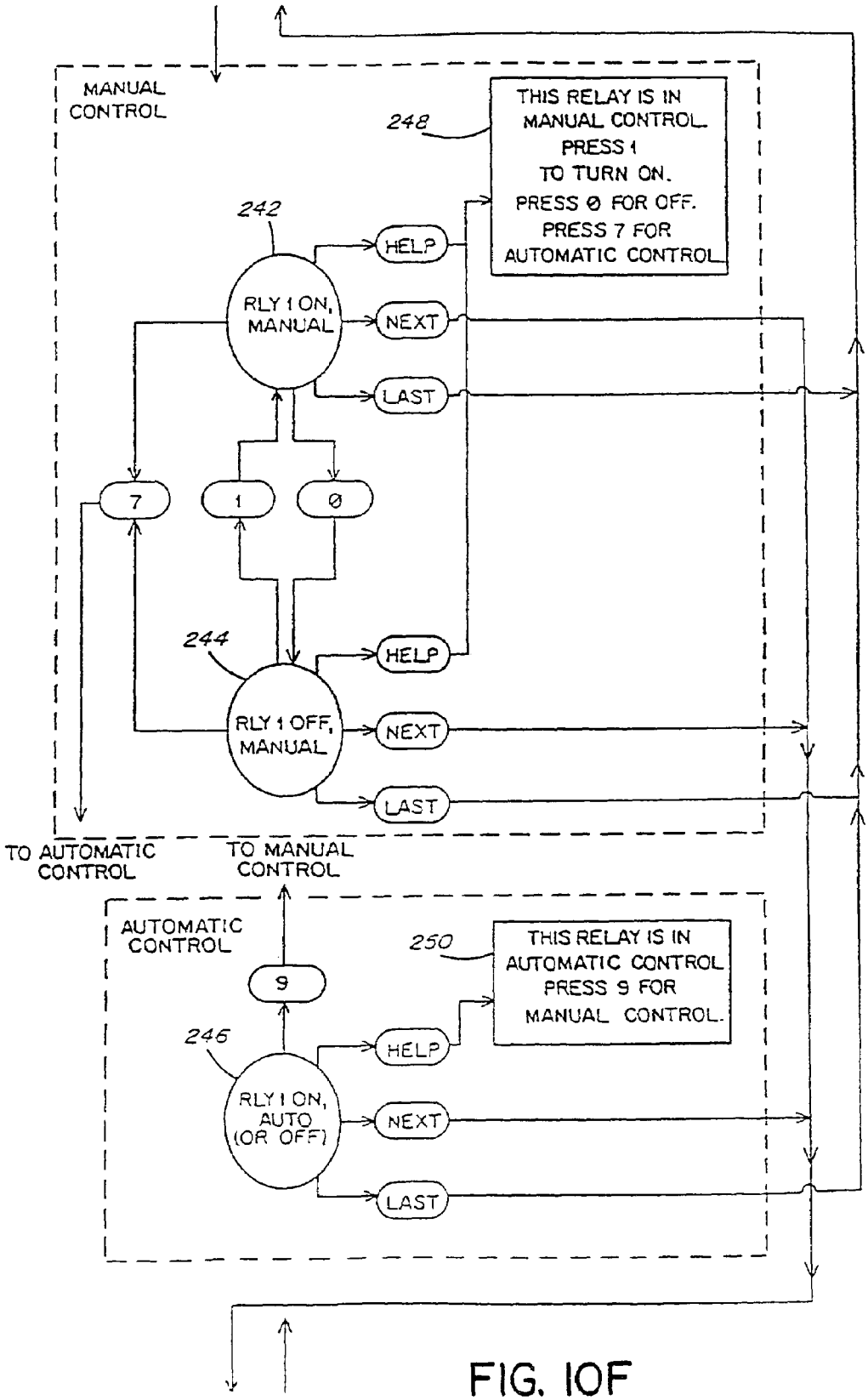
Figure 10G:
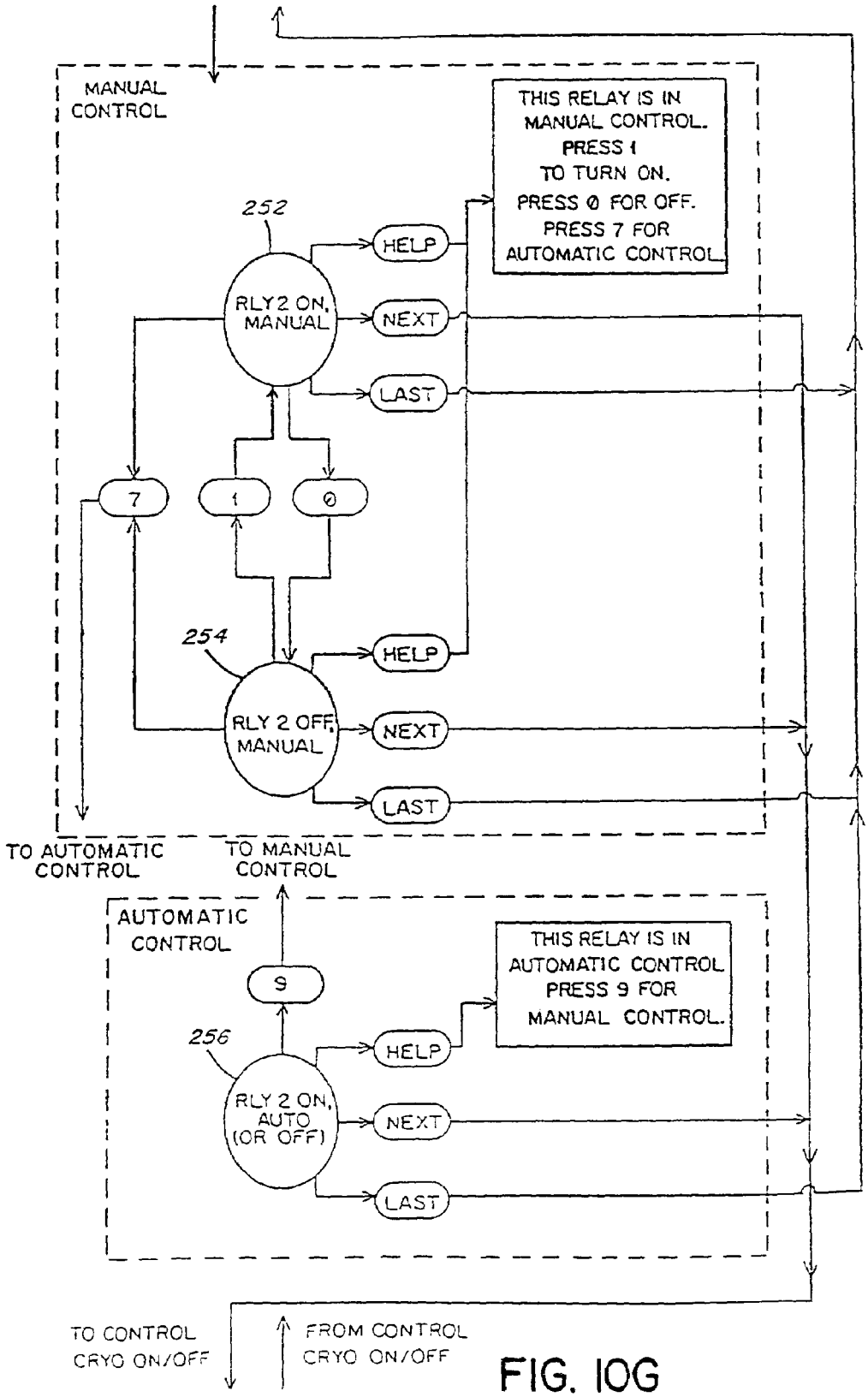
Figure 11A:
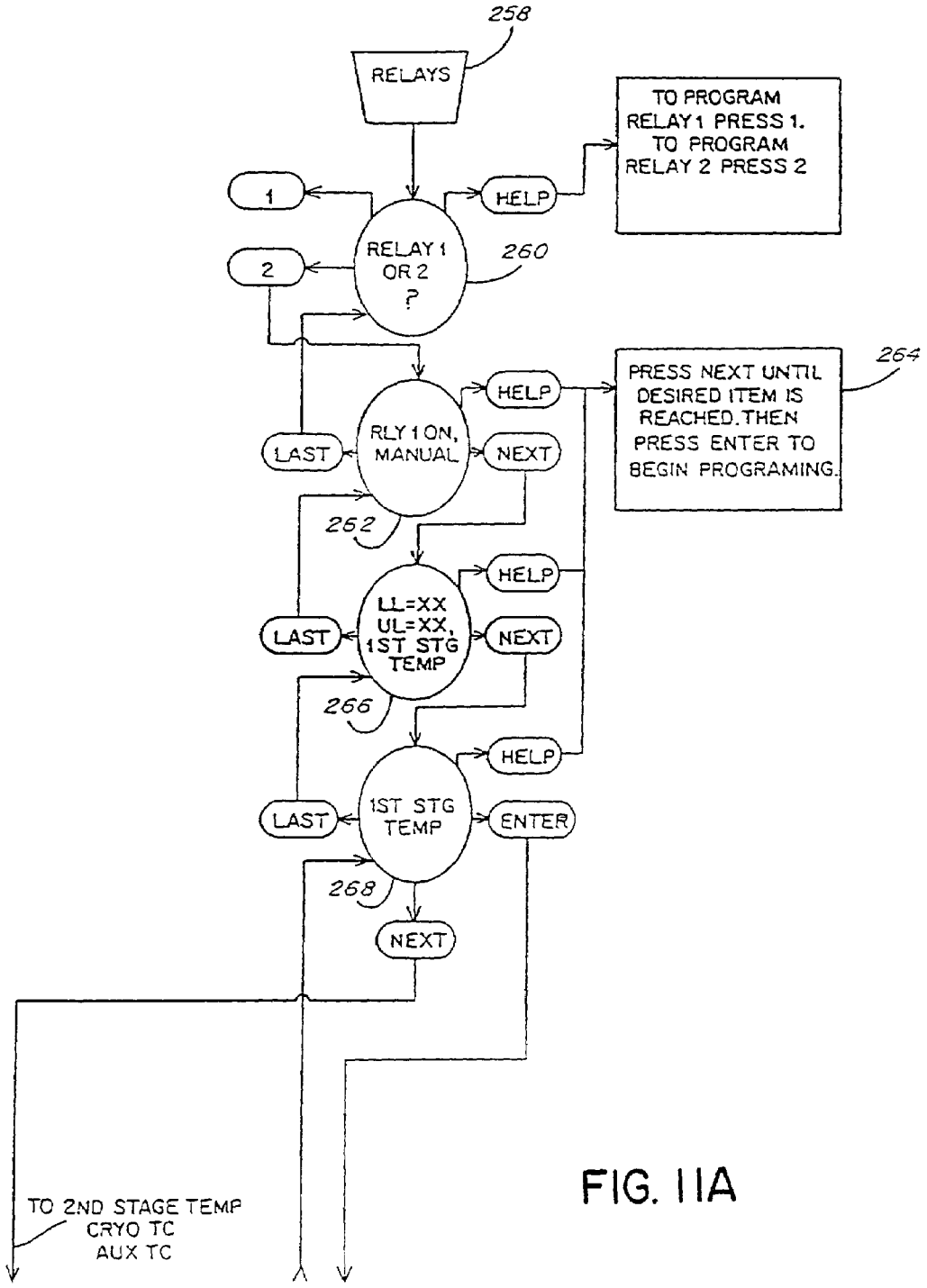
FIGS. 11A–11D are a flowchart of the response of the system when the relay function has been enabled.
Figure 11B:
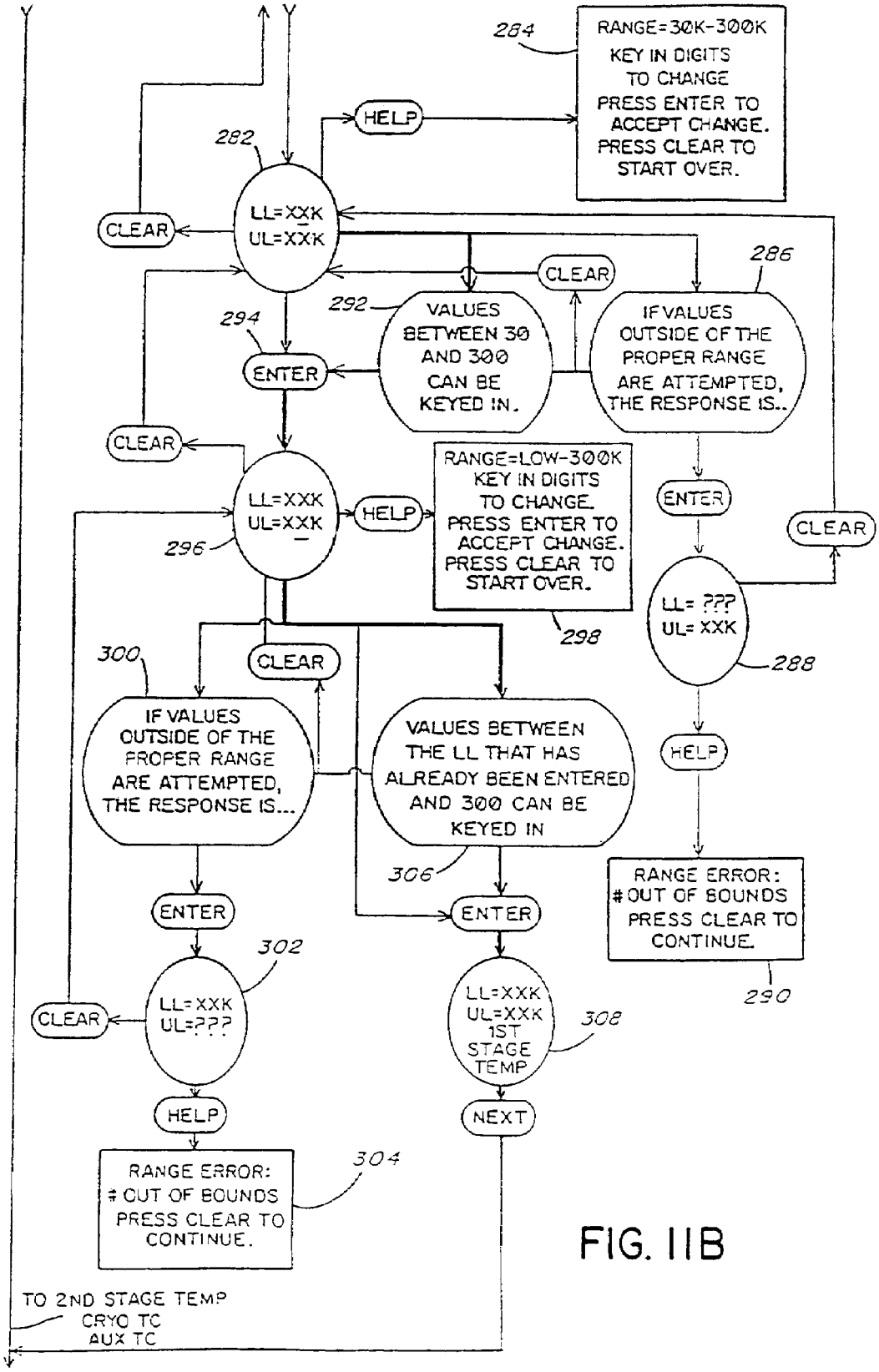
Figure 11C:
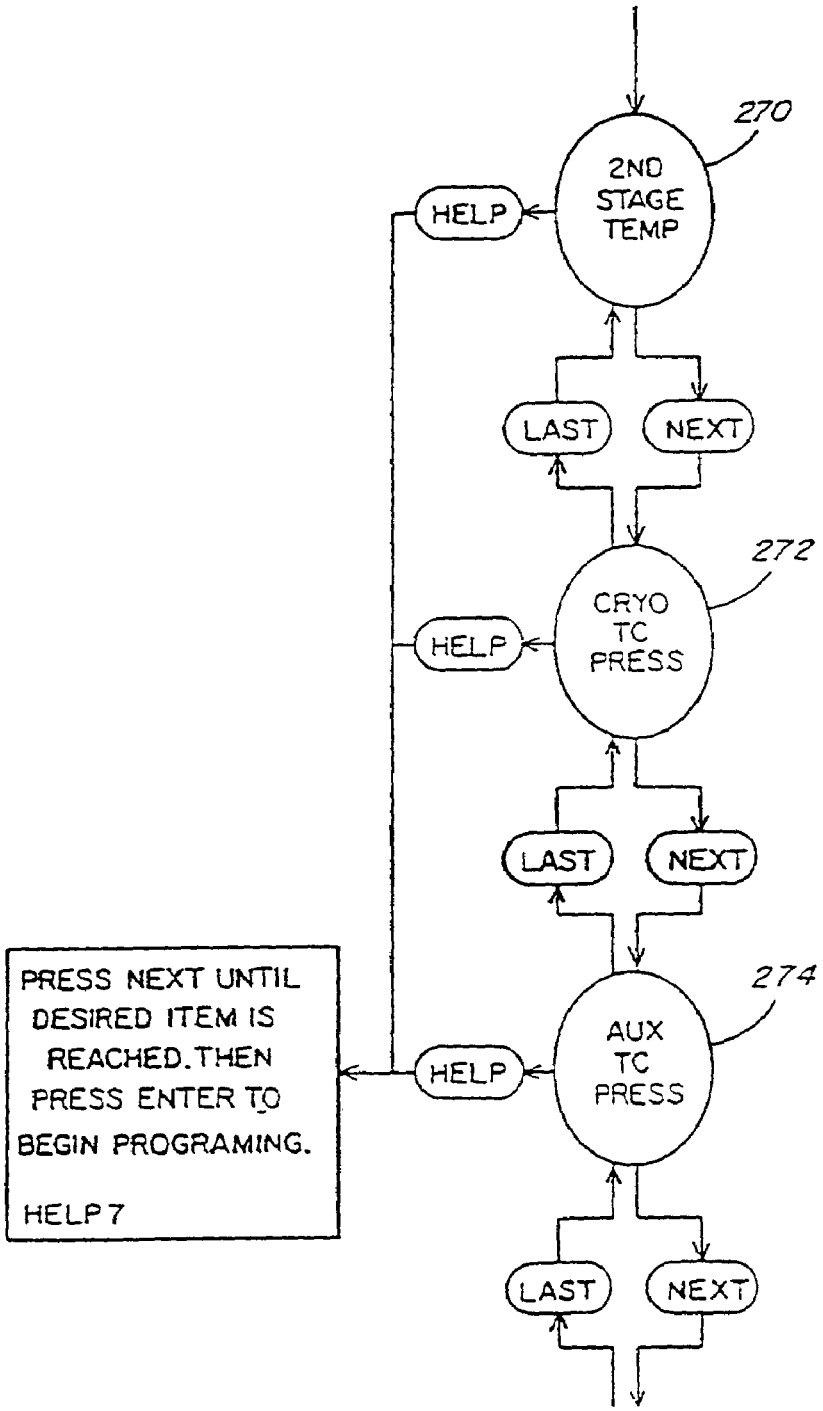
Figure 11D:
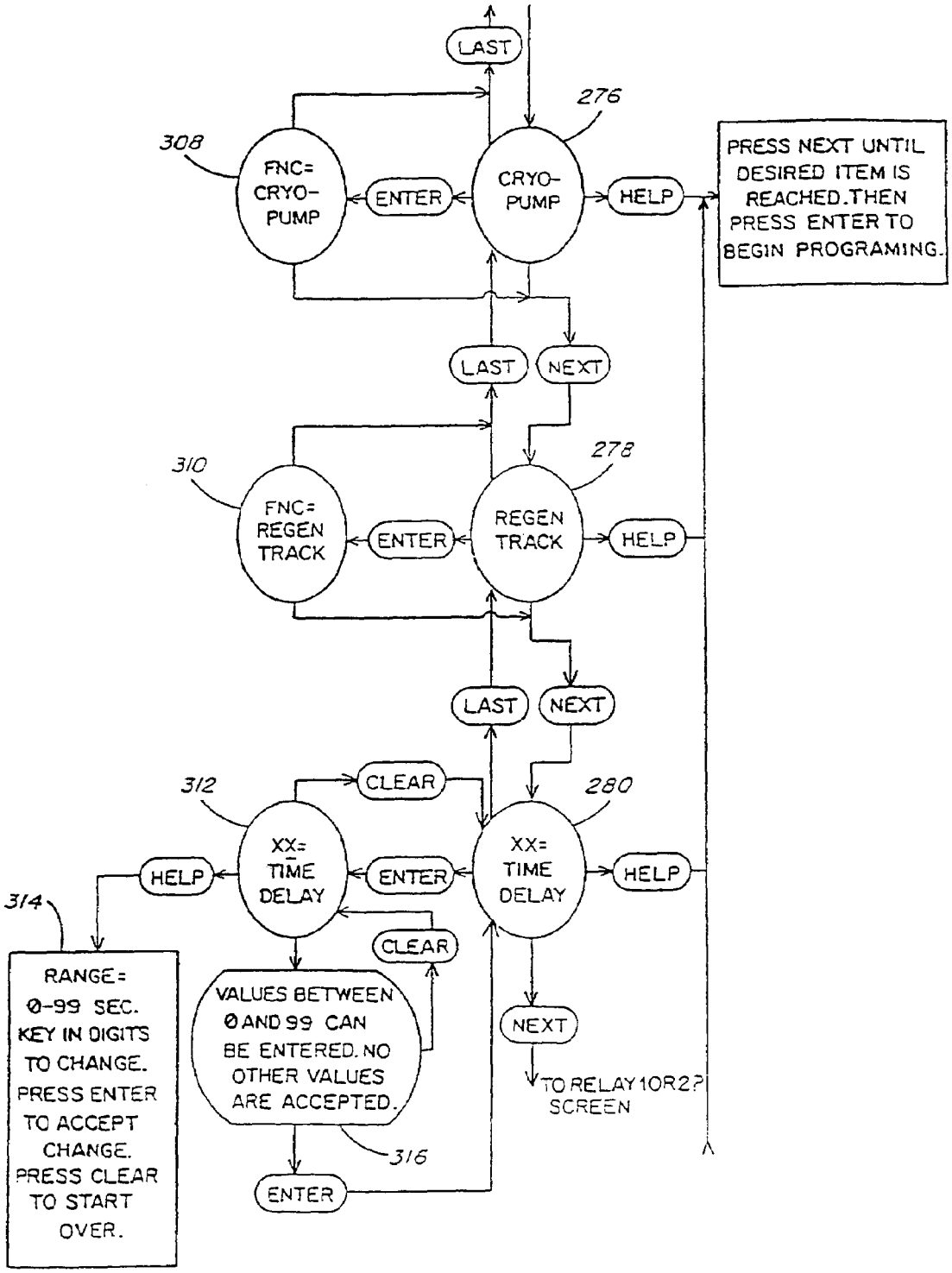

FIG. 8 is a schematic illustration of the electronics of the module 24. It includes a microprocessor 152 which processes a program held as firmware in a read only memory 154. In addition, a battery backed random access memory 156 is provided to store any operational data. With the battery backing, the memory is nonvolatile when power is disconnected from the system. This feature not only allows the data stored in RAM to survive power outages, but also allows the module to be removed without loss of data. In this way, for servicing, the module may be replaced for continued operation of the cryopump yet the data stored in memory may later be withdrawn through the RS232 port to permit further analysis of the prior operation of the cryopump. The module also includes electronics 160 associated with the external connectors. Connector electronics 158 include sensor circuitry and drivers to the motor, heater and valves. Further, the electronics include an electronic potentiometer 161 by which the TC pressure gauge may be zeroed when the cryopump is fully evacuated. The TC pressure gauge is a relatively high pressure gauge which should read zero when the pressure is at 10–4 torr with second-stage temperature of 20K or less. Also included in the electronic module are relays 162 for controlling both local and remote devices and a power sensor 159.

Operation of the system in response to the control panel is illustrated by the flowcharts of FIGS. 9A–14C. When the MONITOR key is first pressed at 170, the alphanumeric display 90 indicates the on/off status of the cryopump and the second-stage temperature at 172. At any stage of the monitor or any other function, the HELP button may be depressed to display a help message. In the monitor function, the message 174 merely indicates that the Next and Last buttons should be pressed to scroll the monitor menu. If the Next button is pressed, a display of the first-stage temperature, second-stage temperature and the pressure reading from the auxiliary TC pressure gauge are displayed at 175. With the Next button pressed repeatedly, the first-stage temperature is displayed at 176, followed by second-stage temperature at 178, the auxiliary TC pressure at 180, and the pressure reading from the cryopump TC pressure gauge 86 at 182. The on/off status of each of two relays which control external functions through the connector 126 may also be displayed at 184 and 186 along with the manual or automatic control mode status of each relay.

FIGS. 10A–10G illustrate the operation of the system after the CONTROL function key is pressed at 188. The on/off status and the second-stage temperature is displayed at 190. As indicated by the help message, the pump may be turned on by pressing 1 or off by pressing zero, or the menu may be scrolled by pressing the Next and Last buttons.

When the cryopump is off at 194, it may be turned on by pressing the 1 button. The microprocessor then checks the status of power to the cryocooler motor. The cryopump receives separate power inputs from the compressor for the cooler motor, the heater and the electronics. If two-phase power is available, the cryopump is turned on; if not, availability of one-phase power is checked at 198. In either case, the no cryopower display 200 or 202 is provided, and operator checks are indicated through help messages at 204 and 206.

In scrolling from the "cryo on" display 190 or "cryo off" display 194 in the control function, one obtains the auxiliary TC status indications. If the gauge is on, the pressure is displayed. Again, the help message 212 indicates how the auxiliary TC may be turned on or off, or how the monitor function displays may be scrolled.

If the control function is again scrolled, the status of the cryopump TC gauge is indicated at 214 or 216. If the TC gauge is 1 off at 216 and the 1 button is pressed, the microprocessor performs a safety check before carrying out the instruction. The TC gauge can only be turned on if the second-stage temperature is below 20K or if the cryopump has been purged as indicated at 218 and 220. If the temperature is below 20K, there is insufficient gas in the pump to ignite. If the cryopump has just been purged, only inert is present. If neither of those conditions exists, a potentially dangerous condition may be present and turning the gauge on is prevented at 222.

Continuing to scroll through the control function, one obtains the open/closed status of the roughing valve at 224 or 226. If the roughing valve is closed at 224, it may be opened by pressing the 1 button. However, the valve is not immediately opened if the cryopump is indicated to be on at 226. Opening the roughing valve may back stream oil from the roughing pump into the cryopump and contaminate the adsorbent. If the cryopump is on, a warning is displayed at 228, and the help message indicates that opening the valve while the cryopump is on may contaminate the cryopump. The system only allows the valve to be opened if the operator presses an additional key 2.

The next item in the control function menu is the status of the purge valve at 232 and 234. Again, if the operator attempts to open the purge valve by pressing the 1 button, the system checks whether the cryopump is on at 236. If so, opening the purge valve may swamp the pump with purge gas, and an additional warning is displayed at 238. The help message indicates that opening the valve may contaminate the cryopump but allows the operator to open the valve by pressing the 2 button.

With the next item on the menu, the on/off status of relay 1 and the manual/automatic mode status of the relay is indicated at 242, 244 and 246. The relay may be switched between the on and off positions if in the manual mode by pressing the zero and 1 buttons and may be switched between manual and automatic modes by pressing the 7 and 9 buttons as indicated by the menu messages 248 and 250. Similarly, the relay 2 status is indicated at 252, 254 and 256 in the next step of the menu.

FIGS. 11A–11D illustrate operation of the system after the RELAYS function button is pressed at 258. This function allows programming of relay set points. First, relay 1 or relay 2 is able to be selected at 260. Then the status of the selected relay is indicated at 262. As indicated by the help message 264, the relays may be reprogrammed by scrolling to a desired item and pressing the enter button. In scrolling through the menu, the current program for automatic operation is indicated at 266. Specifically, it indicates the lower and upper limits of the first-stage temperature for triggering the relay. To reprogram the settings, one scrolls through the menu to the item which is to be programmed and presses the enter button. The menu items from which a relay may be controlled and which may be programmed are the first-stage temperature at 268, the second-stage at 270 (sheet 3), the cryo TC pressure gauge at 272, the auxiliary TC pressure gauge at 274, the cryopump at 276, and the regeneration cycle at 278. A time delay from any of the above may be programmed at 280. When the cryopump and regeneration functions are entered from 276 and 278, a relay is actuated when the cryopump is turned on and when the regeneration cycle is started, respectively. The first four items are based on upper and lower limits. Reprogramming of the limits is discussed below with respect to the first-stage temperature only.

When the screen displays the first-stage temperature under the RELAYS function, and the operator presses the enter button, the lower and upper limits are displayed at 282. As indicated by the help message 284, digits may be keyed in through the control pad to indicate a range within the possible range of 30K to 300K. At 282, the lower limit may be entered. If a value outside the acceptable range is entered at 286, the entry is questioned at 288, and the help message at 290 indicates that the number was out of bounds. The operator must clear and try again. If the entry is properly within the range at 292, the entry is successful when the operator presses the enter button at 294, and the display indicates that the upper limit may be programmed at 296. The help message 298 indicates that the range must be between the lower limit set by the operator and 300K. Again, if an improper entry is made at 300, the display questions the upper limit at 302, and a help message at 304 indicates that the number is out of bounds. The number must be cleared and retried. If the value is within the proper range at 306, the newly programmed lower and upper limits are displayed at 308.

As already noted, the relays may be set to operate between lower and upper limits for one of the second-stage temperature, cryo TC pressure gauge and auxiliary TC pressure gauge in the manner described with respect to the first-stage temperature. The lower and upper limits are 10K and 310K for the second-stage temperature gauge, and 1 micron and 999 micron for each of the TC-pressure gauges. As indicated by the help message 314, the time delay must be from zero to 99 seconds.

Figure 12A:
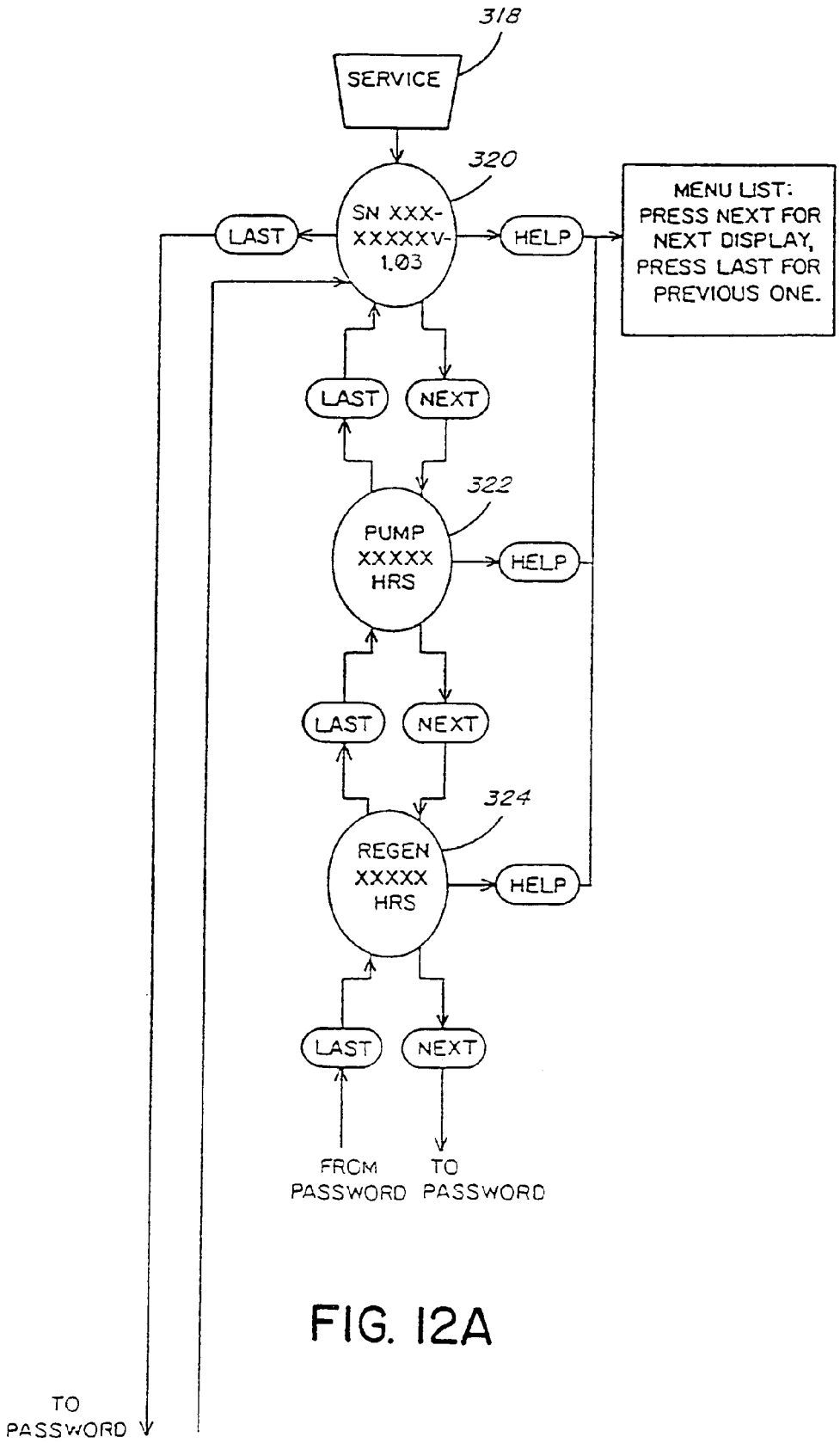
FIGS. 12A–12C are a flowchart of the response of the system when the service function has been enabled.
Figure 12B:
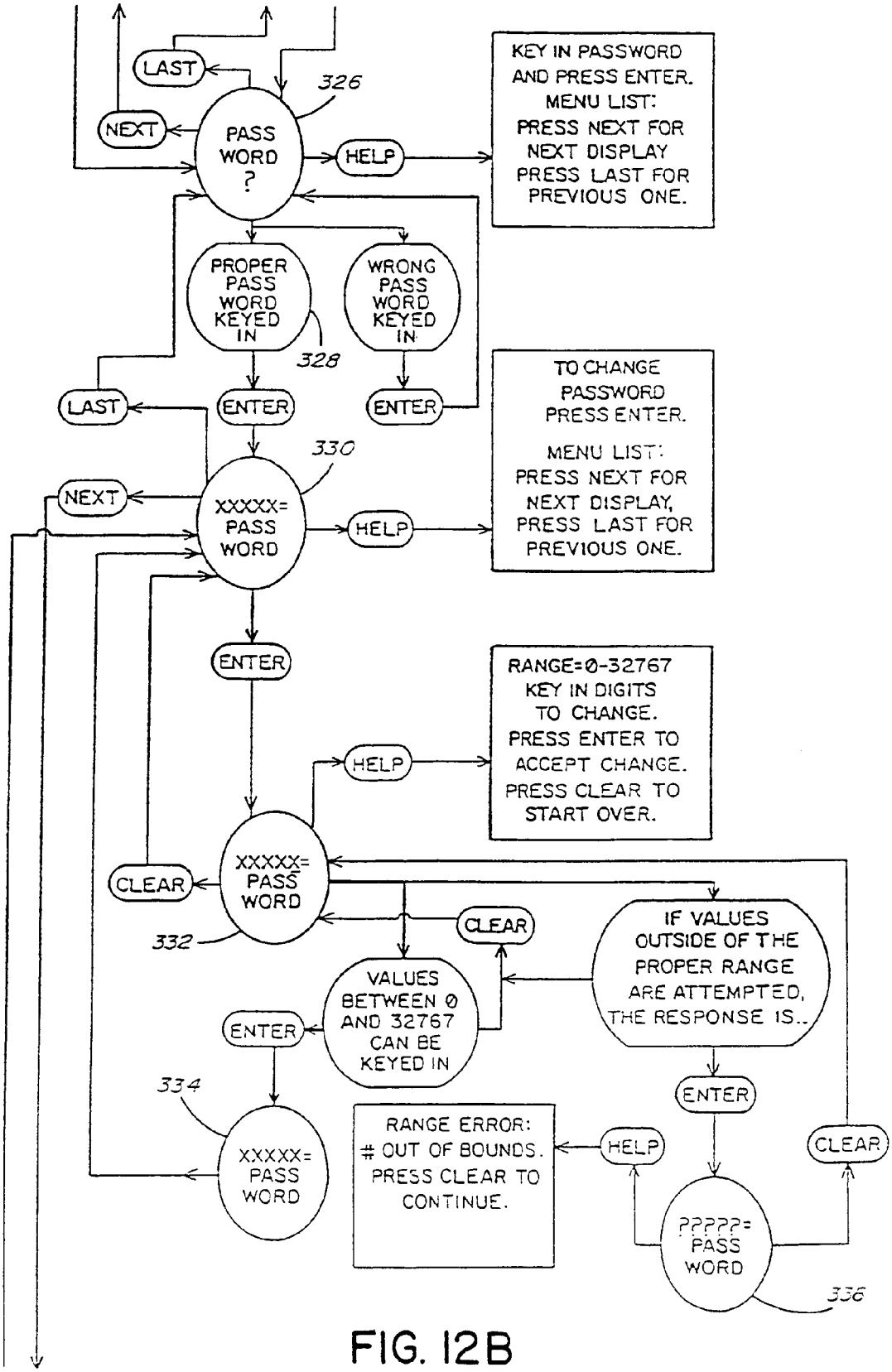
Figure 12C:
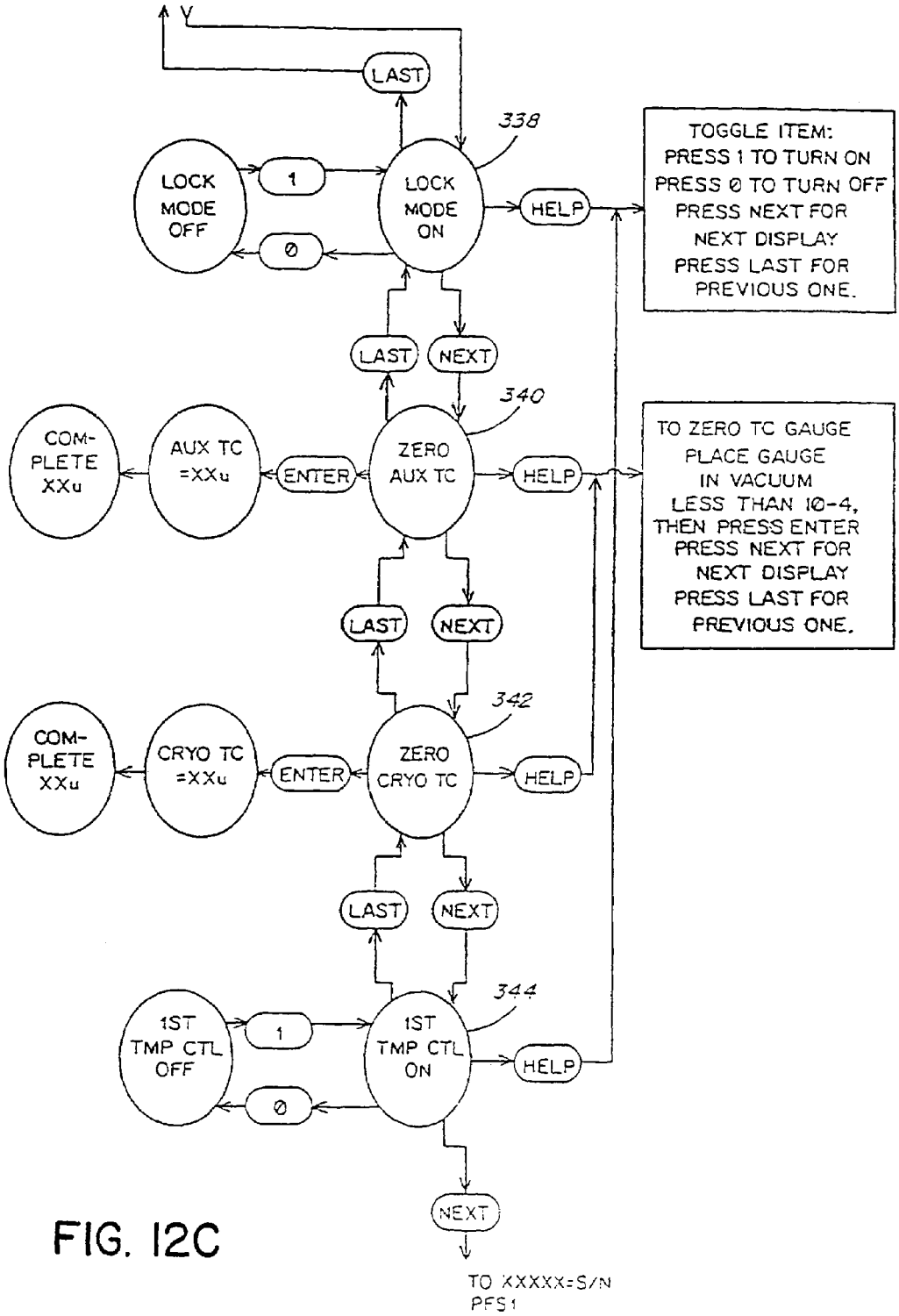

Operation of the system after the SERVICE button is pressed at 318 is illustrated in FIG. 12. The serial number of the cryopump is displayed at 320. Scrolling through the menu, one also obtains the number of hours that the pump has been operating at 322 and the number of hours that the pump has been operating since the last regeneration at 324.

To proceed through the remainder of the service menu, one must have a password. Thus, at 326 the system requests the password. If the proper password is keyed in at 328, the password is displayed at 330, and the operator is able to proceed. At this point, the operator may enter a new password to replace the old at 332. If the value is within an allowable range, it may be entered and displayed at 334. Otherwise, the system questions the password at 336, and the password must be cleared.

From entry of the proper password at 330, the operator may scroll to the lock mode status display at 338. The lock mode inhibits the REGEN, RELAYS and CONTROL functions of the control pad and thus subjects to the password the entire system, but for the MONITOR and the HELP functions and the limited service information presented prior to the password request. Where the lock mode is on, an operator must have access to the proper password in order to enter the full service function and turn the lock mode off before the CONTROL, REGEN or RELAYS functions can be utilized. Thus, there are two levels of protection: the service function by which the lock mode is controlled can only be entered with use of the password; the regen control and relay functions can only be entered where the lock mode has been turned off by an operator with the password. Thus the operator with the password may make the other functions available or not available to operators in general.

Three additional functions which are included within this first level of password protection are the zeroing of the auxiliary and cryopump TC pressure gauges at 340 and 342 and control of the first-stage heater during operation of the cryopump at 344. In the first-stage temperature control node at 344, the heater prevents the temperature of the first-stage from dropping below 65K. It has been found that, where the first-stage is allowed to become cooler than 65K, argon may condense on the first stage during pumpdown. However, to reach full vacuum, the argon must be released from the first stage and pumped by the colder second stage. Thus, the condensation on the first stage delays pumpdown. By maintaining the temperature of the first stage above 65K, such "argon hang-up" is avoided.

The thermocouple gauges are relatively high pressure gauges which should read zero when the vacuum is less than 10–4. Such a vacuum is assured where the second stage is at a temperature less than 20K. Thus, at a condition where a gauge should read zero, it may be set to zero by pressing the enter button at 340 or 342. In the present system, however, these steps are generally unnecessary for the cryopump TC pressure gauge since the microprocessor is programmed to zero the TC gauge after each regeneration. After regeneration, the lowest possible pressure of the system is assured, and this is a best time to zero the gauge.

Figure 13A:
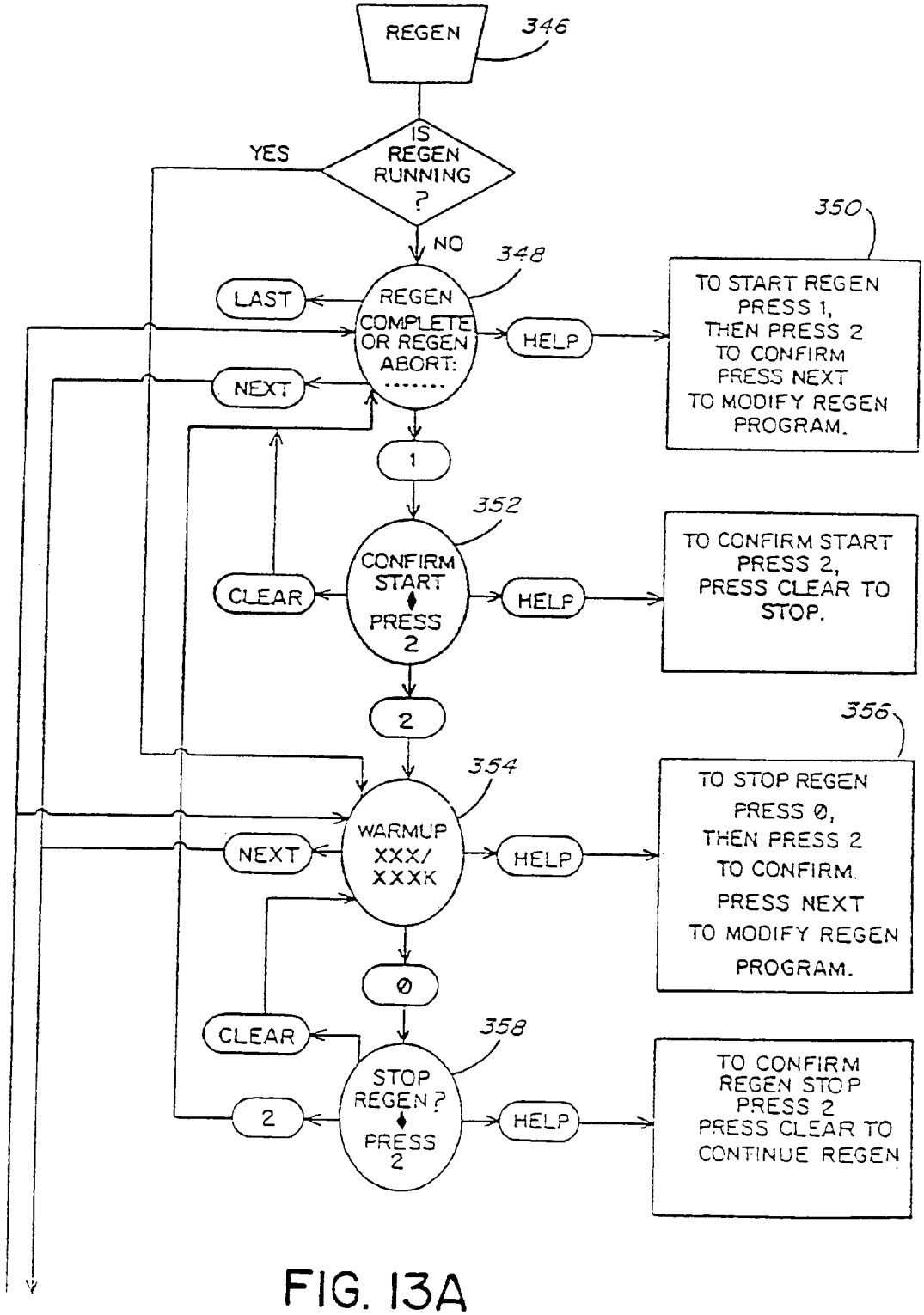
FIGS. 13A–13C are a flowchart of the response of the system when the regeneration function has been enable.
Figure 13B:
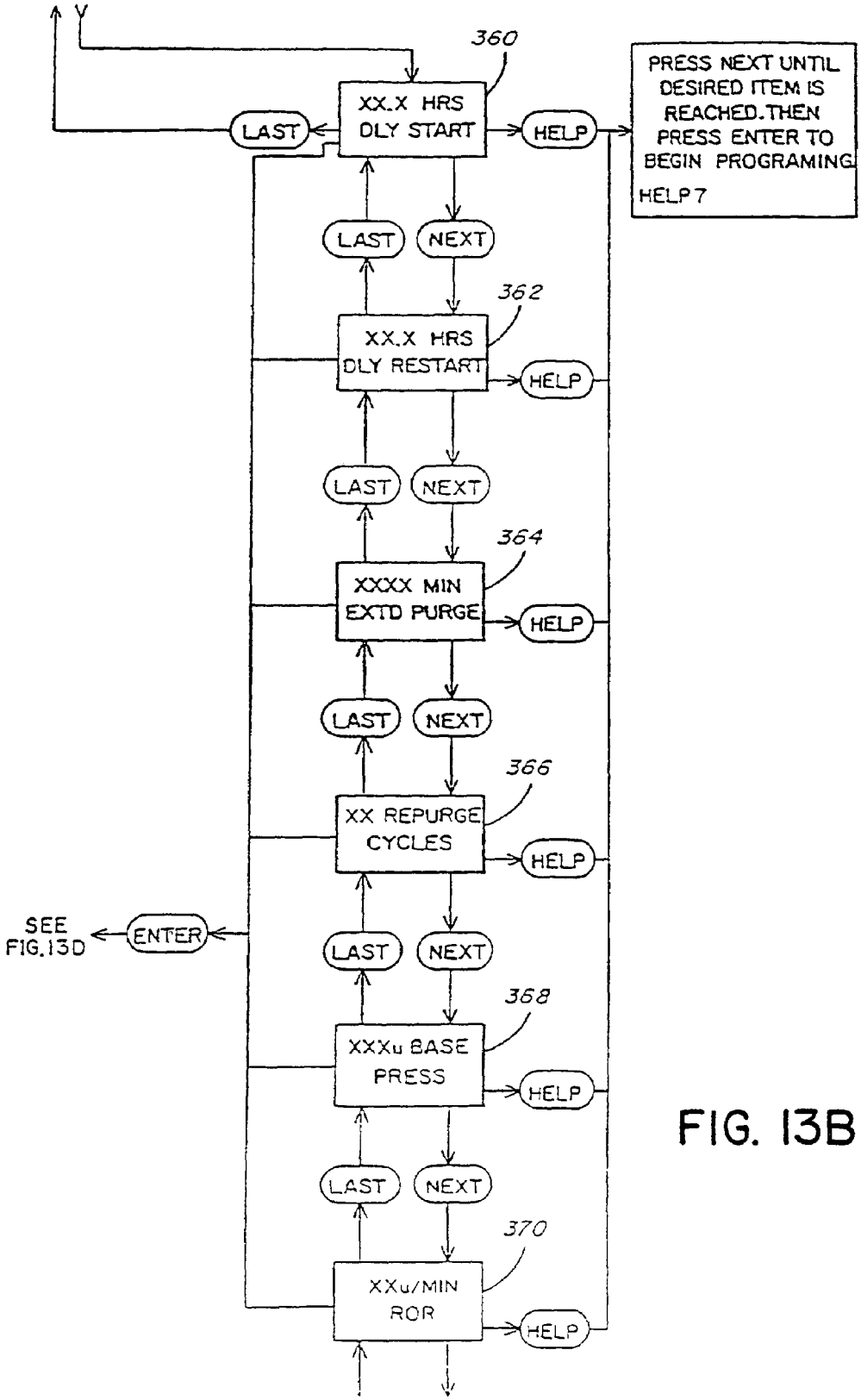
Figure 13C:
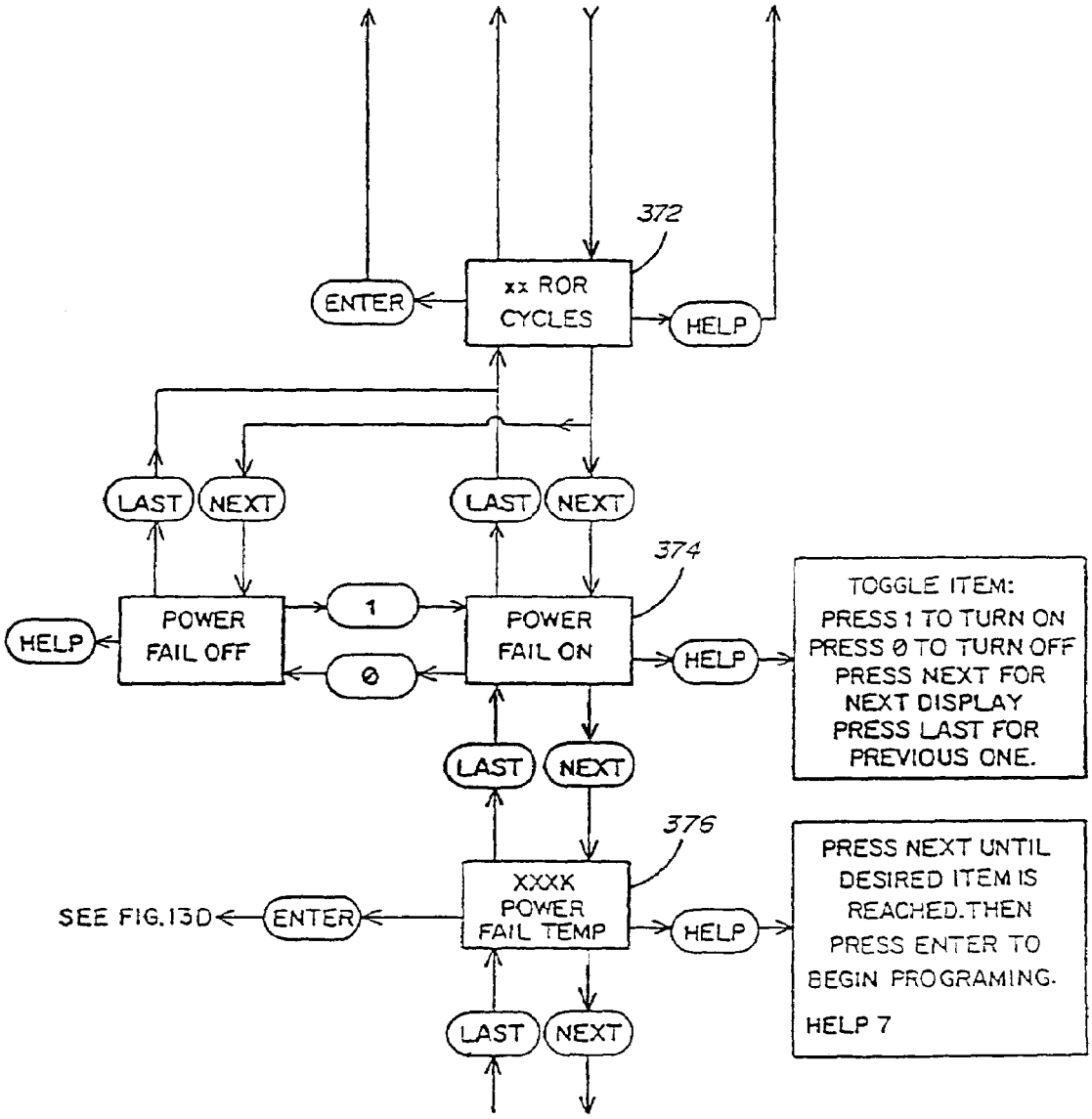

The REGEN function allows both starting and stopping of the regeneration cycle as well as programming of the cycle to be followed when regeneration is started. Operation of the system after the REGEN function key is pressed at 346 is illustrated in FIGS. 13A–13C. If the system is not being regenerated, a message is given at 348. From there the help message 350 indicates that regeneration can be started by pressing 1. When the 1 is pressed, the system asks for confirmation at 352 to assure that the button was not mistakenly pressed. Confirmation is made by pressing button 2 at which time regeneration begins at 354. Regeneration follows the previously programmed regeneration cycle. As indicated by the help message 356, regeneration may be stopped by pressing the zero button with confirmation at 358 by pressing the 2 button.

Programming of the regeneration cycle may be performed by scrolling from 348 or 354 as indicated by the help messages 350 and 356. At 360, a start delay may be programmed into the system. When thus programmed, the cryopump continues to operate for the programmed time after a regeneration is initiated at 348 and 352. A delay of between zero and 99.9 hours may be programmed. At 362, a restart delay of up to 99.9 hours may be programmed into the system. Thus, the regeneration would be performed at the time indicated by the start delay of 360, but the cryopump would not be cooled down for the restart delay after completion of the regeneration sequence. This, for example, allows for starting a weekend regeneration cycle followed by a delay until restart on a Monday morning.

An extended purge time may be programmed at 364. At 366, the number of times that the pump may be repurged if it fails to rough out properly is programmed. Regeneration is aborted after this limit is reached. At 368, the base pressure to which the pump is evacuated before starting a rate of rise test is set. At 370, the rate of rise which must be obtained to pass the rate of rise test is set. At 372, the number of times that the rate of rise test is performed before regeneration is aborted is set. Use of the above parameters in a regeneration process is described in greater detail below with respect to FIGS. 14A–14C.

In the event of a power failure, the system may be set to follow a power failure sequence by entering 1 at 374. Details of the sequence are presented below with respect to FIGS. 15A and 15B.

Figure 13D:
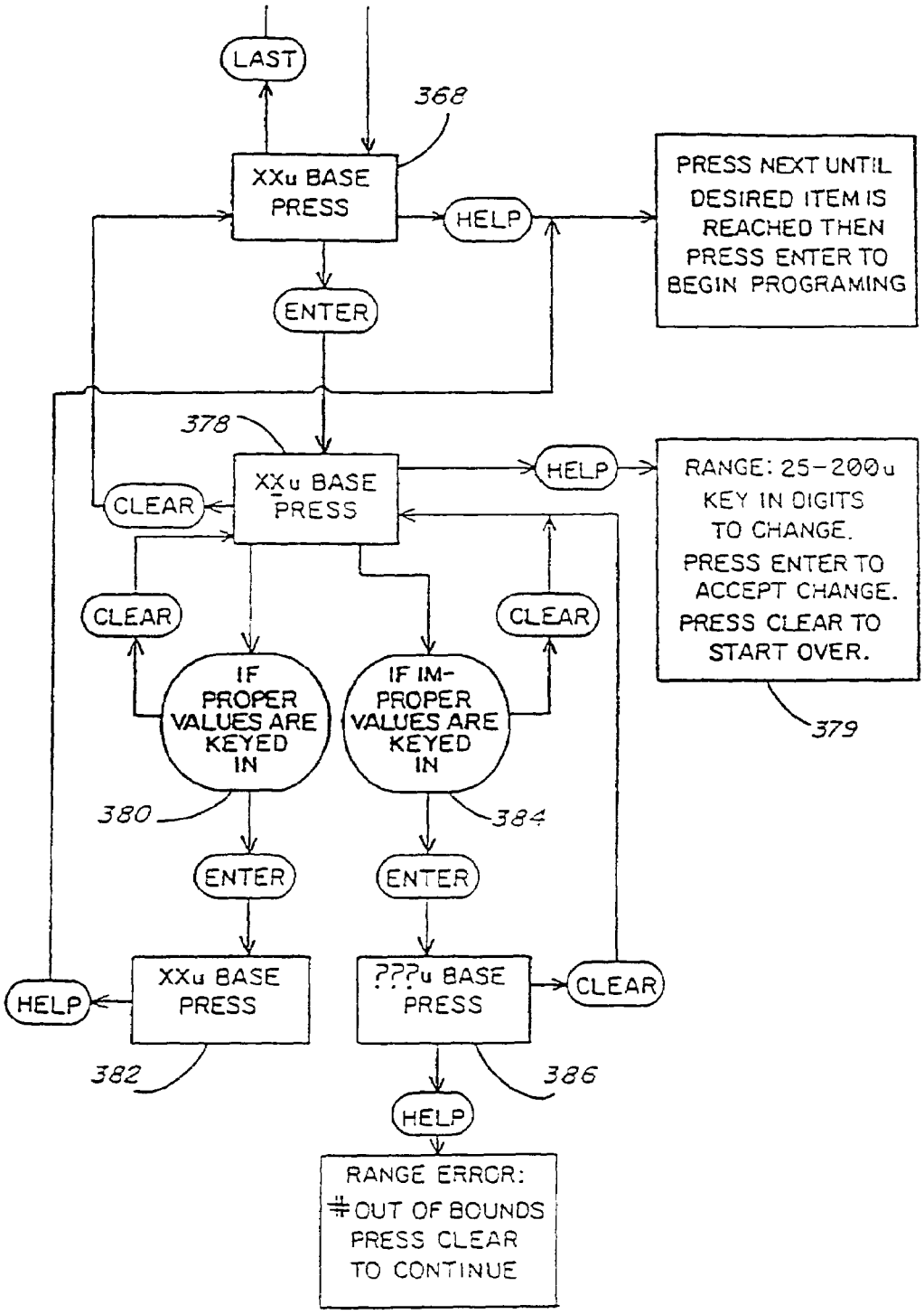
FIG. 13D is an example flowchart for reprogramming an item from FIGS. 13A–13C.

An example of the process of programming a value in the regeneration mode is illustrated in FIG. 13D. This example illustrates programming of the base pressure at 368 of FIGS. 13A–13C. When the enter button is pressed, the base pressure is underlined in the display at 378 and may be set by keying in a value within a range specified in the help message 379. If the number is properly keyed in within that range at 380 and the enter button is pressed, the new base pressure is programmed into the system at 382. If an improper value is keyed in at 384, the system questions the new value at 386.

Figure 14A:
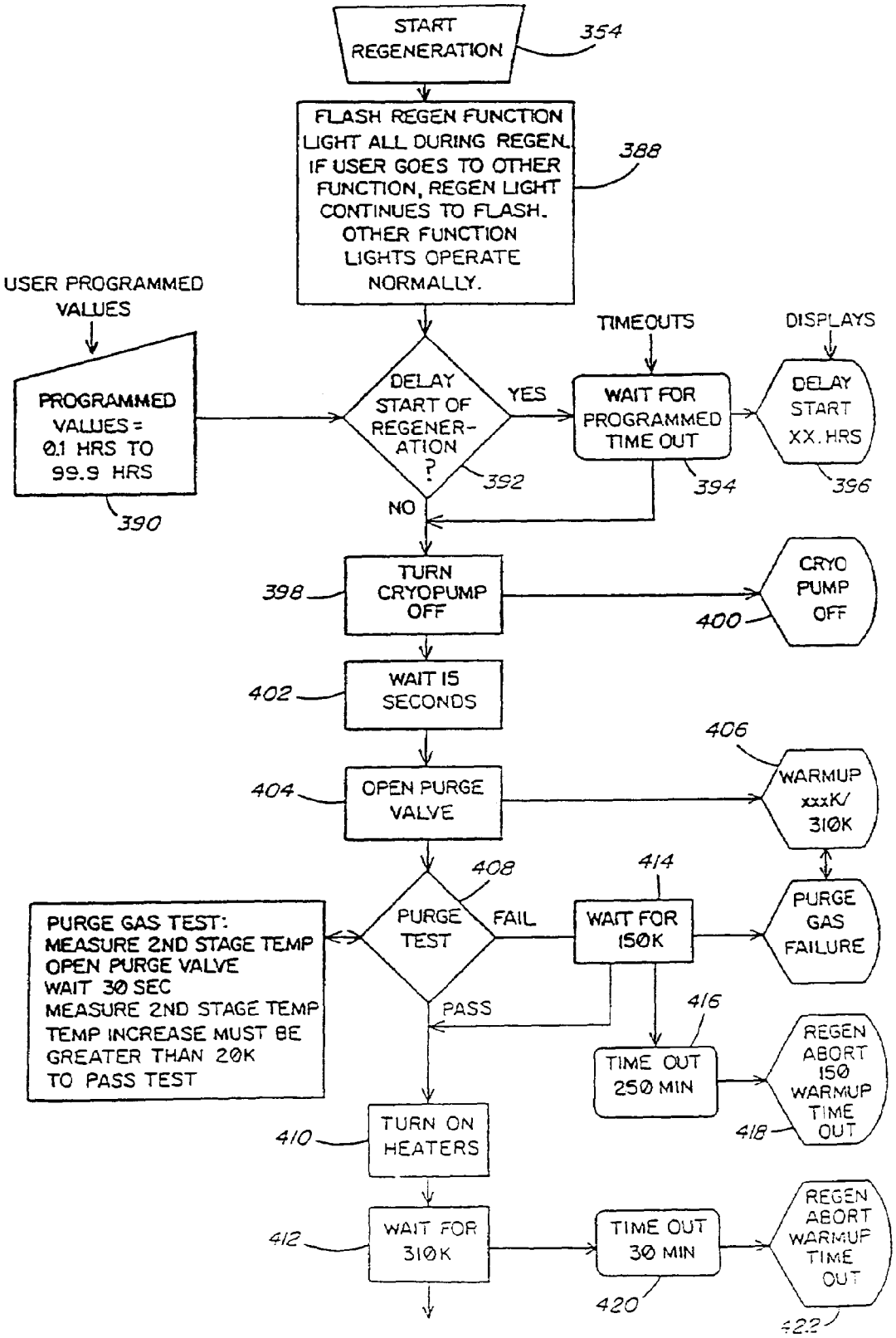
FIGS. 14A–14C are a flowchart of a regeneration process under control of the electronic module.
Figure 14B:
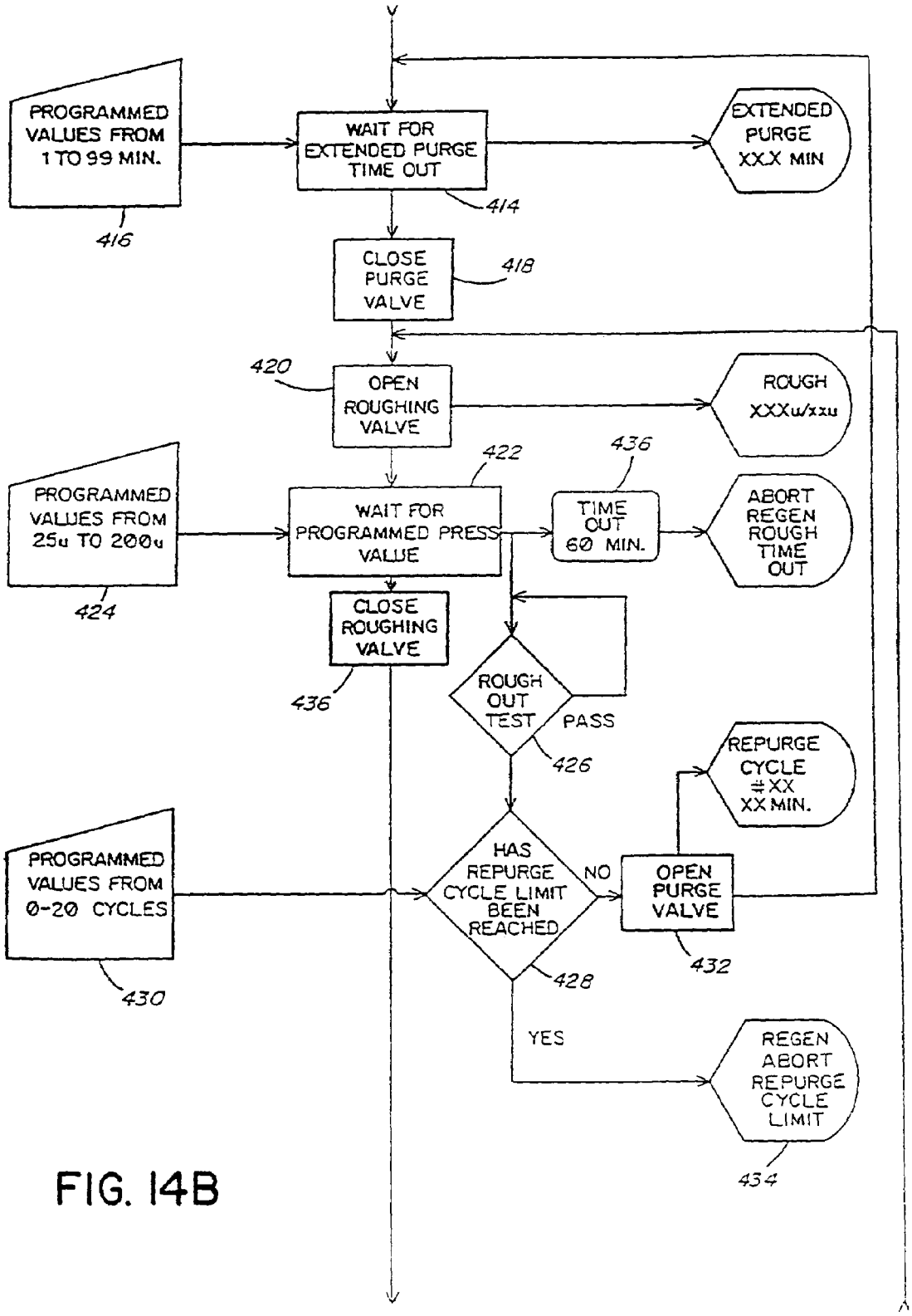
Figure 14C:
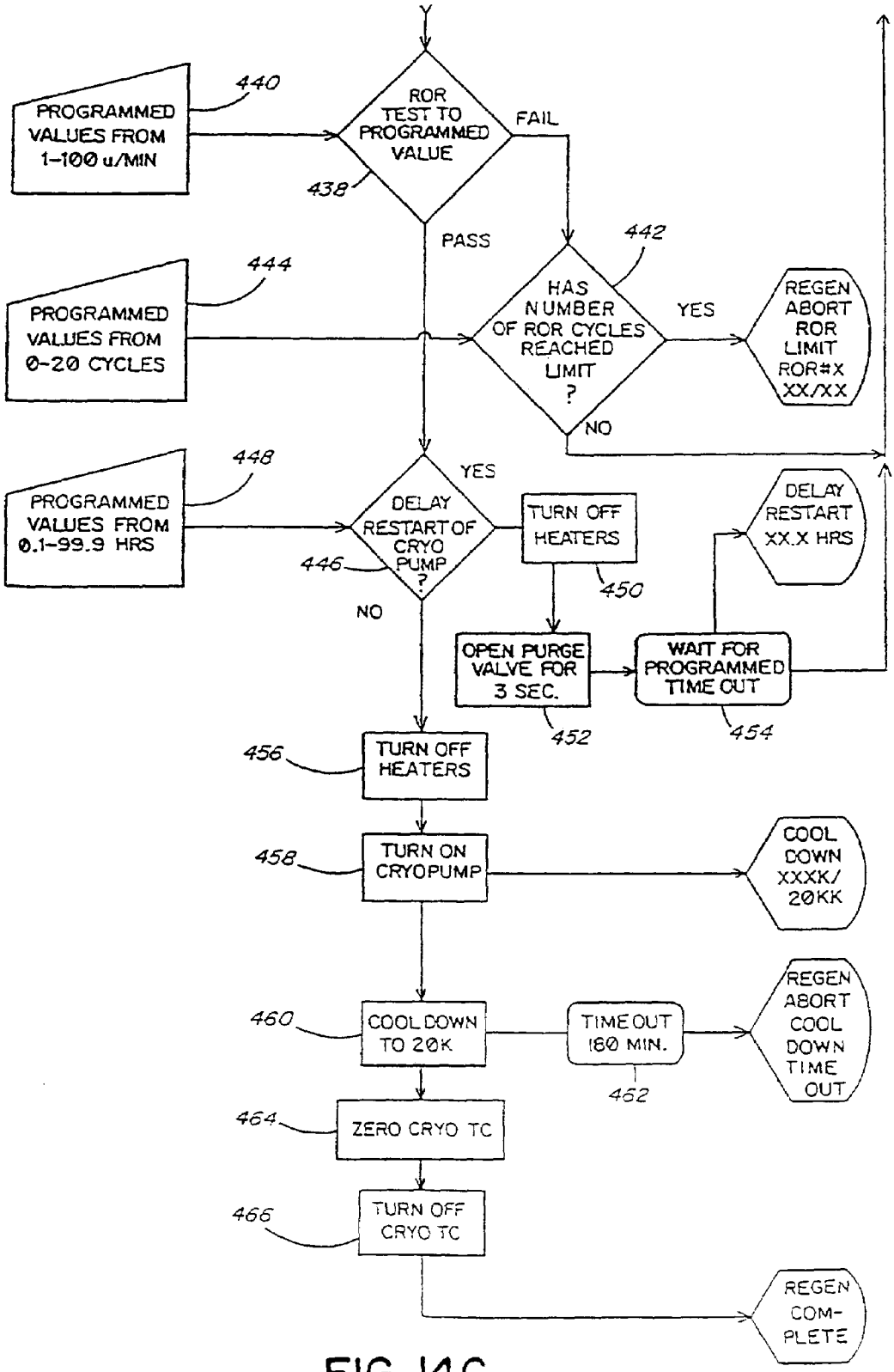

A typical regeneration cycle is illustrated in FIGS. 14A–14C. When the regeneration cycle is initiated at 354 of FIGS. 13A–13C, the regen function light flashes until the regeneration cycle is complete as indicated at 388. The system then looks to the user programmed values 390 to determine whether there is a delay in the start of regeneration at 392. If there is to be a delay, the system waits at 394 and displays the period of time remaining before start as indicated at 396. After the programmed delay, the cryopump is turned off at 398 and the off status is indicated on the display at 400.

After a 15-second wait at 402 to allow set point relays R1 and R2 to activate any external device, the purge valve 80 is opened at 404. Throughout warm-up, the display indicates at 406 the present second-stage temperature and the temperature of 310K to be reached. A purge test is performed at 408. In the purge test, the second-stage temperature is measured and is expected to increase by 20K during a 30-second period. If the system passes the purge test, the heaters are turned on at 410 to raise the temperature to 310K as indicated at 412. If the system fails the purge test, the heaters are not turned on until the second-stage temperature reaches 150K as indicated at 414. If a system fails to reach that temperature in 250 minutes as indicated at 416, regeneration is aborted, as indicated on the display at 418.

After the heaters are turned on, the system must reach 310K within 30 minutes as indicated at 420 or the regeneration is aborted as indicated at 422. After the system has reached 310K, the purge is extended at 414 for the length of time previously programmed into the system at 416. After the extended purge, the purge valve 80 is closed at 418, and the roughing valve 84 is opened at 420. During this time, the roughing pump draws the cryopump chamber to a vacuum at which the cryogenic refrigerator is sufficiently insulated to be able to operate at cryogenic temperatures.

A novel feature of the present system is that the heaters are kept on throughout the rough pumping process to directly heat the cryopumping arrays. The continued heating of the arrays requires a bit more cooling by the cryogenic refrigerator when it is turned on, but evaporates gas from the system and thus results in a more efficient rough pumping process.

The system waits at 422 as rough pumping continues until the base pressure programmed into the system at 424 is reached. During the wait, the rate of pressure drop is monitored in a roughout test at 426. So long as the pressure decreases at a rate of at least two percent per minute, the roughing continues. However, if the pressure drop slows to a slower rate, it is recognized that the pressure is plateauing before it reaches the base pressure, and the system is repurged. In the past, the repurge has only been initiated when the system failed to reach a base pressure within some predetermined length of time. By monitoring the rate of pressure drop, the decision can be made at an earlier time to shorten the regeneration cycle. When the system fails the roughout test at 426, the processor determines at 428 whether the system has already gone through the number of repurge cycles previously programmed at 430. If not, the purge valve is opened at 432, and the system recycles through the extended purge at 414. If the preprogrammed limit of repurge cycles has been reached, regeneration is aborted as indicated at 434. If the total roughing time has exceeded sixty minutes as indicated at 436, regeneration is also aborted.

Once the base pressure is reached with roughing, the roughing valve 84 to the roughing pump is closed at 426. A rate of rise test is then performed at 438. In the rate of rise test, the system waits fifteen seconds and measures the TC pressure and then waits thirty seconds and again measures the TC pressure. The difference in pressures must be less than that programmed for the rate of rise test at 440 or the test fails. With failure, the system determines at 442 whether the number of ROR cycles has reached that previously programmed at 444. If so, regeneration is aborted. If not, the roughing valve is again opened at 420 for further rough pumping.

Once a system has passed the ROR test, it waits at 446 an amount of time previously programmed for delay of restart at 448. If restart is to be delayed, the heaters are turned off at 450, and the purge valve is opened so that the flushed cryopump is backfilled with inert nitrogen. The system then waits for the programmed delay for restart before again opening the roughing valve at 420 and repeating the roughing sequence. Thus, regeneration is completed promptly through the ROR test even where restart is to be delayed. This gives greater opportunity to correct any problems noted in regeneration and avoids delays in restart due to extended cycling in the regeneration cycle. However, the regenerated system is not left at low pressure because the low pressure might allow air and water to enter the pump and contaminate the arrays if any leak is present. Rather, the regenerated system is held with a volume of clean nitrogen gas. Later, when the restart delay has passed, the system is again rough pumped from 420 with the full expectation of promptly passing the ROR test at 438.

When the cryopump is to be restarted after successful rough pumping, the heaters are turned off at 456, and the cryopump is turned on at 458. The system is to cool down to 20K within 180 minutes as indicated at 462 or regeneration is aborted. Once cooled to 20K, the cryopump TC pressure gauge is automatically zeroed at 464. As previously discussed, the system is now at its lowest pressure, and at this time the TC pressure gauge should always read zero. The cryopump TC pressure gauge is then turned off at 466 and regeneration is complete.

Figure 15A:
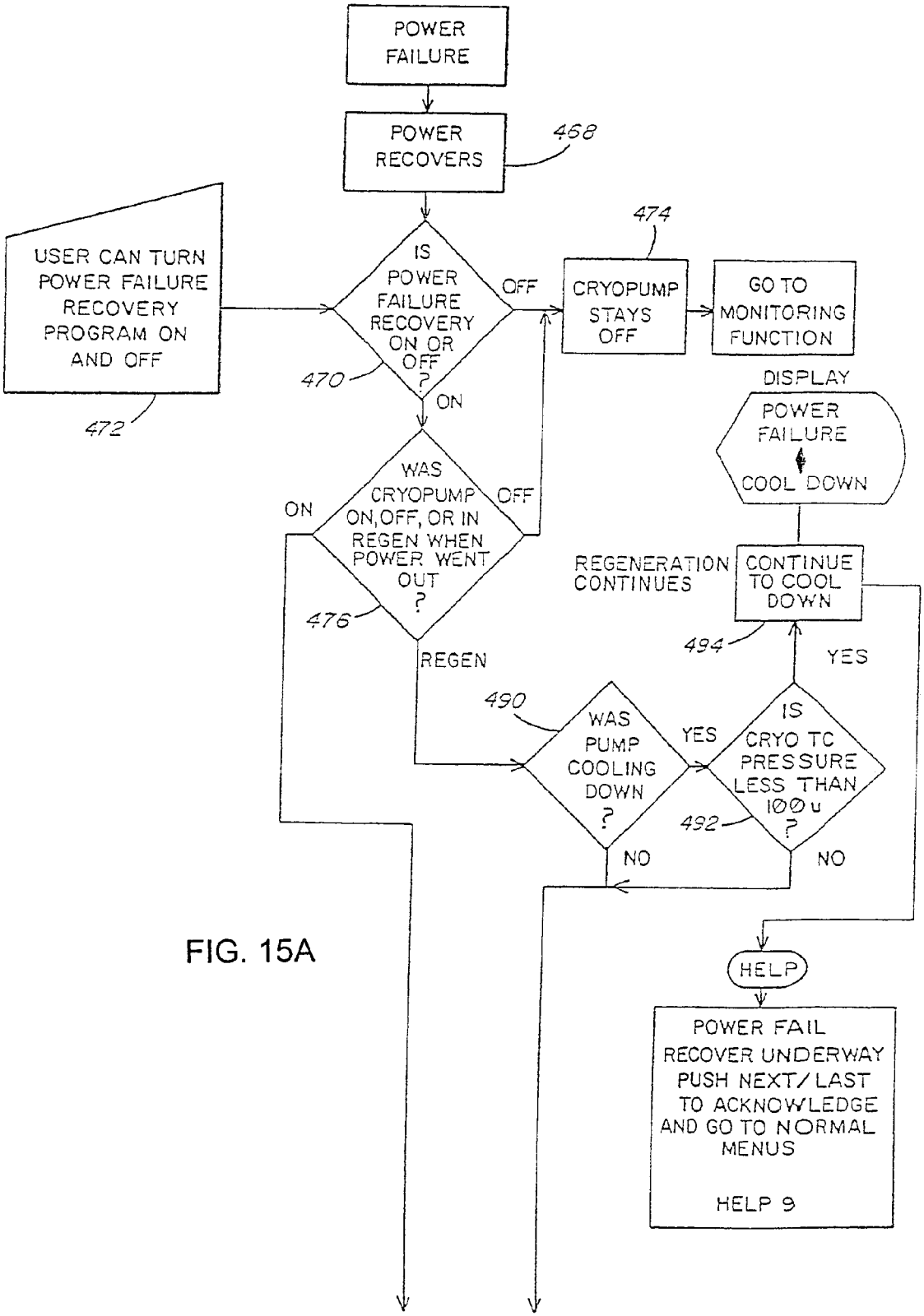
FIGS. 15A and 15B are a flowchart of a power failure recovery sequence.
Figure 15B:
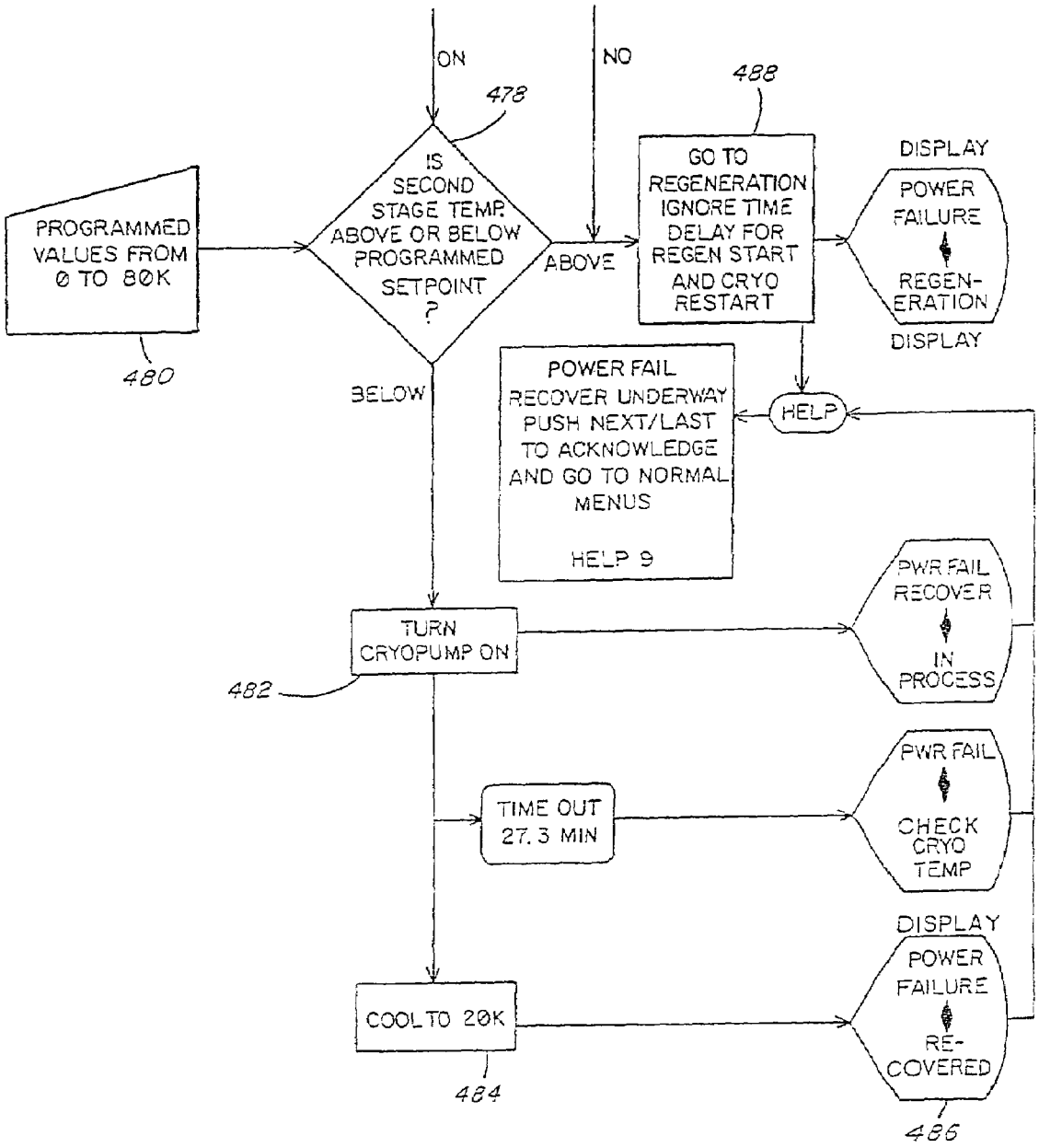

FIGS. 15A and 15B is a flowchart of the power failure recovery sequence. After power recovers as indicated at 468, the system checks at 470 the operator program at 472 to determine whether the recovery sequence is to be followed. If not, the cryopump stays off as indicated at 474. If so, the system determines at 476 whether the cryopump was on, off or in regeneration when the power went out. If off, the cryopump remains off. If the pump was on, the system checks at 478 whether the second stage is above or below the set point programmed at 480. If it is below the set point, the cryopump is turned on at 482 and cooled to 20K at 484 where the display at 486 indicates that the system has recovered after power failure. If it does not cool to below 20K within thirty minutes, a warning is given to the operator to check the temperature so that he can be sure the pump is within the operating parameters needed for his process. If the temperature of the second stage is not below the programmed set point, the system starts regeneration at 488 without any programmed delays for regeneration start and cryopump restart.

If at 476 it is determined that the system had already been in regeneration, it determines at 490 whether the pump was in the process of cooling down. If not, the regeneration cycle is restarted at 488. If the pump was cooling down, the system determines whether the cryopump TC gauge indicates a pressure of less than 100 microns. If not, regeneration is restarted at 488. If so, cool down is continued at 494 to complete the original regeneration cycle. After power failure, the "regen start" and "cryo restart" delays are always ignored because the time of power outage is unknown and the system errs in favor of an operational system.

Although it is often important to prevent casual operation of the system through the control pad by unauthorized personnel, it is also important that the system not be shut down because an individual having the password is not available. The present system allows for override of the password by service personnel. However, service personnel are not always immediately available, and it may be desirable to override the password through a phone communication. Thus, it is desirable to be able to provide the user with an override password which can be input on the control pad. On the other hand, one would not want the individual to thereafter have unlimited access to the cryopump control at later times, so the override password must have a limited life. To that end, the microprocessor is programmed to respond to a password which the system can determine to be valid for only the present state of the system. It stores a cryptographic algorithm from which, based on its time of operation, it can compute the valid override password. Similarly, a trusted source has access to the same algorithm. If the password is to be bypassed, the operator provides the trusted source with the operating time of the cryopump which is indicated in the service function at 322 of FIG. 12. That time is generally different for each pump in a system and is never repeated for a pump. The trusted source then computes the override password and gives the password to the operator over the telephone. When input into the system, the system confirms by computing the override password from its own algorithm and then provides the password which had previously been programmed into the system by the unavailable operator. When the unavailable operator returns, the operator would presumably code a new password into the system. The override password would no longer be usable because the operating time of the system would change.

When coupled to a computer terminal through the RS232 port, all of the functions available through the control pad may be performed through the computer terminal. Further, additional information stored in the battery-backed RAM is available for service diagnostics. Specifically, the computer terminal may have access to the specific diode calibrations for the first- and second-stage temperature sensing diodes. The electronic module may store and provide to the central computer a data history as well. In particular, the system stores the following data with respect to the first ten regenerations of the system and the most recent ten regenerations: cool down time, warm-up time, purge time, rough out time, regenerator ROR cycles, and final ROR value. The system also stores the time since the last regeneration and the total number of regenerations completed. By storing the data with respect to the first ten regenerations, service personnel are able to compare the more recent cryopump operation with that of the cryopump when it was new and possibly predict problems before they occur.

While this invention has been particularly shown and described with references to a preferred embodiment thereof, it will be understood by those skilled in the art that various changes in form and details may be made therein without departing from the spirit and scope of the invention as defined by the appended claims.

What is claimed is:

1. A method of controlling a cryopump, the method comprising:

coupling a heater to a cryopumping surface of the cryopump; and controlling the heater during operation of the cryopump to maintain a temperature of the cryopumping surface of the cryopump.

2. A method according to claim 1 wherein the heater is controlled by feedback from a temperature sensor.

3. A method according to claim 2 further including shutting off the heater in response to receiving feedback indicating a temperature outside of a normal range.

4. A method according to claim 2 wherein the cryopumping surface further includes first and second cryopumping surfaces, each cryopumping surface having a heater.

5. A method according to claim 2 wherein the heater is controlled proportionally by the feedback from the temperature sensor.

6. A method according to claim 1 wherein the heater maintains a first stage of the cryopump.

7. A method according to claim 6 wherein the temperature is maintained above 65K.

8. A method according to claim 1 wherein the heater is an electric heater.

9. A cryopump comprising:

a heater coupled to a cryopumping surface of the cryopump; and an electronic controller which maintains a temperature of the cryopumping surface of the cryopump by controlling the heater during operation of the cryopump.

10. A cryopump as in claim 9 wherein the heater is controlled by feedback from one or more temperature sensors coupled to the cryopump.

11. A cryopump as in claim 10 wherein the controller shuts off the heater when the temperature sensed by one or more of the temperature sensors is outside a normal temperature range.

12. A cryopump as in claim 10 wherein the cryopumping surface further includes:

first and second cryopumping surfaces;

the first cryopumping surface having a heater; and the second cryopumping surface having a heater.

13. A cryopump as in claim 9 wherein the heater is controlled proportionally by the feedback from the temperature sensor.

14. A cryopump as in claim 9 wherein the heater maintains a temperature of a first stage of the cryopump.

15. A cryopump as in claim 14 wherein the temperature is above 65K.

16. A cryopump as in claim 9 wherein the heater is an electric heater.

17. A system for controlling a cryopump comprising:

means for heating a cryopumping surface of the cryopump; and means for controlling the heater during operation of the cryopump to maintain a temperature of the cryopumping surface of the cryopump.

18. A method of controlling a cryopump, the method comprising:

coupling a heater integrally to a cryopumping surface of the cryopump; and controlling the heater during operation of the cryopump to maintain a temperature of the cryopumping surface of the cryopump.

19. A cryopump comprising:

a heater coupled integrally to a cryopumping surface of the cryopump; and an electronic controller which maintains a temperature of the cryopumping surface of the cryopump by controlling the heater during operation of the cryopump.

* * * * *